US010991376B2

(12) United States Patent
Svedberg et al.

(10) Patent No.: US 10,991,376 B2
(45) Date of Patent: Apr. 27, 2021

(54) METHODS, ENCODER AND DECODER FOR HANDLING LINE SPECTRAL FREQUENCY COEFFICIENTS

(71) Applicant: Telefonaktiebolaget LM Ericsson (publ), Stockholm (SE)

(72) Inventors: Jonas Svedberg, Luleå (SE); Stefan Bruhn, Sollentuna (SE); Martin Sehlstedt, Luleå (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 154 days.

(21) Appl. No.: 16/347,229

(22) PCT Filed: Nov. 28, 2017

(86) PCT No.: PCT/EP2017/080678
§ 371 (c)(1),
(2) Date: May 3, 2019

(87) PCT Pub. No.: WO2018/108520
PCT Pub. Date: Jun. 21, 2018

(65) Prior Publication Data

US 2019/0279651 A1 Sep. 12, 2019

Related U.S. Application Data

(60) Provisional application No. 62/435,173, filed on Dec. 16, 2016.

(51) Int. Cl.
*G10L 19/06* (2013.01)
*G10L 19/038* (2013.01)
*G10L 19/07* (2013.01)

(52) U.S. Cl.
CPC ..... *G10L 19/06* (2013.01); *G10L 19/038* (2013.01); *G10L 19/07* (2013.01)

(58) Field of Classification Search
CPC ..... G10L 19/06; G10L 19/07; G10L 19/038
See application file for complete search history.

(56) References Cited

U.S. PATENT DOCUMENTS 5,802,487 A 9/1998 Tanaka
2004/0015346 A1* 1/2004 Yasunaga ..... G10L 19/07 704/219

(Continued)

OTHER PUBLICATIONS

3rd Generation Partnership Project, "3rd Generation Partnership Project; Technical Specification Group Services and System Aspects; Mandatory Speech Codec Speech Processing Functions; Adaptive Multi-Rate (AMR) Speech Codec; Transcoding Functions (Release 13)", Technical Specification, 3GPP TS 26.090 V13.0.0, Dec. 1, 2015, pp. 1-55, 3GPP.

(Continued)

*Primary Examiner* — Huyen X Vo
(74) *Attorney, Agent, or Firm* — Coats & Bennett, PLLC

(57) ABSTRACT

A method and apparatus for handling input Line Spectral Frequency, LSF, coefficients. The method comprises determining LSF residual coefficients as first compressed LSF coefficients subtracted from the input LSF coefficients, and transforming the LSF residual coefficients into a warped domain. One of a plurality of gain-shape coding schemes is applied on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients. A representation of the first compressed LSF coefficients, the gain-shape coded LSF residual coefficients, and information on the applied gain-shape coding scheme are transmitted over a communication channel to a decoder.

20 Claims, 8 Drawing Sheets

(56) References Cited

U.S. PATENT DOCUMENTS

2004/0176951 A1* 9/2004 Sung ..... G10L 19/07
704/222
2009/0299737 A1* 12/2009 Ghenania ..... G10L 19/173
704/219
2017/0053659 A1* 2/2017 Subasingha ..... G10L 19/005

OTHER PUBLICATIONS

Iwakami, N. et al., "High-Quality Audio-Coding at Less Than 64 KBIT/S by Using Transform-Domain Weighted Interleave Vector Quantization (TWINVQ)", 1995 International Conference on Acoustics, Speech, and Signal Processing, May 9, 1995, pp. 3095-3098, IEEE.

Pan, J., "Two-Stage Vector Quantization-Pyramidal Lattice Vector Quantization and Application to Speech LSP Coding", 1996 IEEE International Conference on Acoustics, Speech, and Signal Processing Conference Proceedings, May 9, 1996, pp. 737-740, IEEE.

Kabal, P. et al., "The Computation of Line Spectral Frequencies Using Chebyshev Polynomials", IEEE Transactions on Acoustics, Speech, and Signal Processing, vol. ASSP-34 No. 6, Dec. 1, 1986, pp. 1419-1426, IEEE.

Makhoul, J., "Linear Prediction: A Tutorial Review", Proceedings of the IEEE, vol. 63 No. 4, Apr. 1, 1975, pp. 561-580 , IEEE.

Vasilache, A. et al., "Flexible Spectrum Coding in the 3GPP EVS Codec", 2015 IEEE International Conference on Acoustics, Speech and Signal Processing, Apr. 19, 2015, pp. 5878-5882, IEEE.

Valin, J. et al., "Definition of the Opus Audio Codec", Internet Engineering Task Force (IETF), Nov. 1, 2012, pp. 1-327, RFC 6716, IETF.

Fischer, T., "A Pyramid Vector Quantizer", IEEE Transactions on Information Theory, vol. IT-32 No. 4, Jul. 1, 1986, pp. 568-583, IEEE.

ETSI, "Universal Mobile Telecommunications System (UMTS); LTE; Codec for Enhanced Voice Services (EVS); Detailed Algorithmic Description (3GPP TS 26.445 Version 13.0.0 Release 13)", Technical Specification, ETSI TS 126 445 V13.0.0, Feb. 1, 2016, pp. 1-657, ETSI.

Pan, J., "Extension of Two-Stage Vector Quantization-Lattice Vector Quantization", IEEE Transactions on Communications, vol. 45 No. 12, Dec. 1, 1997, pp. 1538-1547, IEEE.

* cited by examiner

METHODS, ENCODER AND DECODER FOR HANDLING LINE SPECTRAL FREQUENCY COEFFICIENTS

TECHNICAL FIELD

The present embodiments generally relate to speech and audio encoding and decoding, and in particular to quantization of Line Spectral Frequency coefficients.

BACKGROUND

When handling audio signals such as speech at an encoder of a transmitting unit, the audio signals are represented digitally in a compressed form using for example Linear Predictive Coding, LPC. As LPC coefficients are sensitive to distortions, which may occur to a signal transmitted in a communication network from a transmitting unit to a receiving unit, the LPC coefficients are transformed to Line Spectral Frequencies, LSF, or LSF coefficients, at the encoder. Further, the LSFs may be compressed, i.e. coded, in order to save bandwidth over the communication interface between the transmitting unit and the receiving unit.

The LSF coefficients provide a compact representation of a spectral envelope, especially suited for speech signals. LSF coefficients are used in speech and audio coders to represent and transmit the envelope of the signal to be coded. The LSFs are a representation typically based on Linear prediction. The LSFs comprise an ordered set of angles in the range from 0 to pi, or equivalently a set of frequencies from [0 to Fs/2], where Fs is the sampling frequency of the time domain signal. The LSF coefficients can be quantized on the encoder side and are then sent to the decoder side. LSF coefficients are robust to quantization errors due to their ordering property. As a further benefit, the input LSF coefficient values are easily used to weigh the quantization error for each individual LSF coefficient, a weighing principle which coincides well with a wish to reduce the codec quantization error more in perceptually important frequency areas than in less important areas.

Legacy methods, such as AMR-WB (Adaptive Multi-Rate Wide Band), use a large stored codebook or several medium sized codebooks in several stages, such as Multistage Vector Quantizer (MSVQ) or Split MSVQ, for LSF, or Immitance Spectral Frequencies (ISF), quantization, and typically make an exhaustive search in codebooks that is computationally costly.

Alternatively, an algorithmic VQ can be used, e.g. in EVS (Enhanced Voice Service) a scaled $D8^+$ lattice VQ is used which applies a shaped lattice to encode the LSF coefficients. The benefit of using a structured lattice VQ is that the search in codebooks may be simplified and the storage requirements for codebooks may be reduced, as the structured nature of algorithmic Lattice VQs can be used. Other examples of lattices are D8, RE8. In some EVS mode of operation, Trellis Coded Quantization, TCQ, is employed for LSF quantization. TCQ is also a structured algorithmic VQ.

There is an interest to achieve an efficient compression technique requiring low computational complexity at the encoder.

SUMMARY

An object of embodiments herein is to provide computationally efficient and compression efficient handling of the LSF coefficients.

According to an aspect there is presented a method performed by an encoder for handling input Line Spectral Frequency, LSF, coefficients. The method comprises determining LSF residual coefficients as first compressed LSF coefficients subtracted from the input LSF coefficients, and transforming the LSF residual coefficients into a warped domain. One of a plurality of gain-shape coding schemes is applied on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients. A representation of the first compressed LSF coefficients, the gain-shape coded LSF residual coefficients, and information on the applied gain-shape coding scheme are transmitted over a communication channel to a decoder.

According to an aspect there is presented a method performed by a decoder for handling input Line Spectral Frequency, LSF, coefficients. The method comprises receiving, over a communication channel from an encoder, a representation of first compressed LSF coefficients, gain-shape coded LSF residual coefficients, and information on an applied gain-shape coding scheme, applied by the encoder. One of a plurality of gain-shape decoding schemes is applied on the received gain-shape coded LSF residual coefficients according to the received information on applied gain-shape coding scheme, in order to achieve LSF residual coefficients, where the plurality of gain-shape decoding schemes have mutually different trade-offs in one or more of gain resolution and shape resolution for one or more of the gain-shape coded LSF residual coefficients. The LSF residual coefficients are transformed from a warped domain into an LSF original domain, and LSF coefficients are determined as the transformed LSF residual coefficients added with the received first compressed LSF coefficients.

According to an aspect there is presented an encoder configured to perform the method for handling input Line Spectral Frequency, LSF, coefficients.

According to an aspect there is presented a decoder configured to perform the method for handling input Line Spectral Frequency, LSF, coefficients.

According to an aspect there is presented an apparatus for handling input Line Spectral Frequency, LSF, coefficients. The apparatus is configured to determine LSF residual coefficients as first compressed LSF coefficients subtracted from the input LSF coefficients, and to transform the LSF residual coefficients into a warped domain. It is further configured to apply one of a plurality of gain-shape coding schemes on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients. The apparatus is further configured to transmit, over a communication channel to a decoder, a representation of the first compressed LSF coefficients, the gain-shape coded LSF residual coefficients, and information on the applied gain-shape coding scheme.

According to an aspect there is presented an apparatus for handling input Line Spectral Frequency, LSF, coefficients. The apparatus is configured to receive, over a communication channel from an encoder, a representation of first compressed LSF coefficients, gain-shape coded LSF residual coefficients, and information on an applied gain-shape coding scheme, applied by the encoder. The apparatus is further configured to apply one of a plurality of gain-shape decoding schemes on the received gain-shape coded LSF residual coefficients according to the received information on applied gain-shape coding scheme, in order to achieve LSF residual coefficients, where the plurality of gain-shape decoding schemes have mutually different trade-offs in one or more of gain resolution and shape resolution for one or more of the gain-shape coded LSF residual coefficients. The apparatus is further configured to transform the LSF residual coefficients from a warped domain into an LSF original domain, and to determine LSF coefficients as the transformed LSF residual coefficients added with the received first compressed LSF coefficients.

According to an aspect there is provided a computer program, comprising instructions which, when executed by a processor, cause an apparatus to perform the actions of the method for handling input Line Spectral Frequency, LSF, coefficients.

DETAILED DESCRIPTION

The figures are schematic and simplified for clarity, and they merely show details for the understanding of the embodiments presented herein, while other details have been left out.

Figure 1:
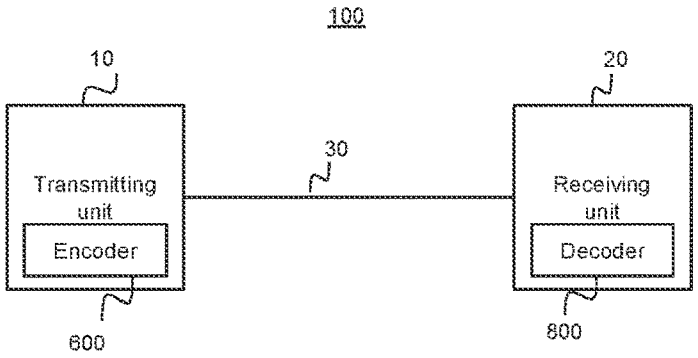
FIG. 1 shows a communication network comprising a transmitting unit and a receiving unit.

FIG. 1 shows a communication network 100 comprising a transmitting unit 10 and a receiving unit 20. The transmitting unit 10 is connected with the receiving unit 20 via a communication channel 30. The communication channel 30 may be a direct connection or an indirect connection via one or more routers or switches. The communication channel 30 may be through a wireline connection, e.g. via one or more optical cables or metallic cables, or through a wireless connection, e.g. a direct wireless connection or a connection via a wireless network comprising more than one link. The transmitting unit 10 comprises an encoder 1600. The receiving unit 20 comprises a decoder 1800.

Figure 2:
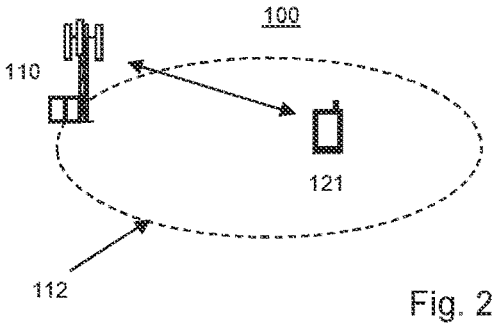
FIG. 2 shows an exemplary wireless communications network in which embodiments herein may be implemented.

FIG. 2 depicts an exemplary wireless communications network 100 in which embodiments herein may be implemented. The wireless communications network 100 may be a wireless communications network such as an LTE (Long Term Evolution), LTE-Advanced, Next Evolution, WCDMA (Wideband Code Division Multiple Access), GSM/EDGE (Global System for Mobile communications/Enhanced Data rates for GSM Evolution), UMTS (Universal Mobile Telecommunication System) or WiFi (Wireless Fidelity), or any other similar cellular network or system.

The wireless communications network 100 comprises a network node 110. The network node 110 serves at least one cell 112. The network node 110 may be a base station, a radio base station, a nodeB, an eNodeB, a Home Node B, a Home eNode B or any other network unit capable of communicating with a wireless device within the cell 112 served by the network node depending e.g. on the radio access technology and terminology used. The network node may also be a base station controller, a network controller, a relay node, a repeater, an access point, a radio access point, a Remote Radio Unit, RRU, or a Remote Radio Head, RRH.

In FIG. 2, a wireless device 121 is located within the first cell 112. The device 121 is configured to communicate within the wireless communications network 100 via the network node 110 over a radio link, also called wireless communication channel, when present in the cell 112 served by the network node 110. The wireless device 121 may e.g. be any kind of wireless device such as a mobile phone, cellular phone, Personal Digital Assistants, PDA, a smart phone, tablet, sensor equipped with wireless communication abilities, Laptop Mounted Equipment, LME, e.g. USB, Laptop Embedded Equipment, LEE, Machine Type Communication, MTC, device, Machine to Machine, M2M, device, cordless phone, e.g. DECT (Digital Enhanced Cordless Telecommunications) phone, or Customer Premises Equipment, CPEs, etc. In embodiments herein, the mentioned encoder 1600 may be situated in the network node 110 and the mentioned decoder 1800 may be situated in the wireless device 121, or the encoder 1600 may be situated in the wireless device 121 and the decoder 1800 may be situated in the network node 110.

Figure 3:
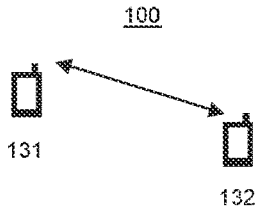
FIG. 3 shows an exemplary communication network comprising a first and a second short-range radio enabled communication devices.

Embodiments described herein may also be implemented in a short-range radio wireless communication network such as a Bluetooth based network. In a short-range radio wireless communication network communication may be performed between different short-range radio communication enabled communication devices, which may have a relation such as the relation between an access point/base station and a wireless device. However, the short-range radio enabled communication devices may also be two wireless devices communicating directly with each other, leaving the cellular network discussion of FIG. 2 obsolete. FIG. 3 shows an exemplary communication network 100 comprising a first and a second short-range radio enabled communication devices 131, 132 that communicate directly with each other via a short-range radio communication channel. In embodiments described herein, the mentioned encoder 1600 may be situated in the first short-range radio enabled communication device 131 and the mentioned decoder 1800 may be situated in the second short-range radio enabled communication device 132, or vice versa. Naturally both communication devices comprise an encoder as well as a decoder to enable two-way communication.

Alternatively, the communication network may be a wireline communication network.

As part of the developing of the embodiments described herein, a problem will first be identified and discussed.

When transmitting LSFs from a transmitting unit comprising an encoder to a receiving unit comprising a decoder there is an interest to achieve a better compression technique, requiring low bandwidth for transmitting the signal and low computational complexity at the encoder and the decoder.

According to one embodiment, such a problem may be solved by a method performed by an encoder of a communication system for handling input LSF coefficients, $LSF_{in}$. The method comprises determining LSF residual coefficients as first compressed LSF coefficients subtracted from the input LSF coefficients and transforming the LSF residual coefficients into a warped domain. The method further comprises applying one of a plurality of gain-shape coding schemes on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients; and transmitting, over a communication channel to a decoder, a representation of the first compressed LSF coefficients, the gain-shape coded LSF residual coefficients, and information on the applied gain-shape coding scheme.

Figure 4:
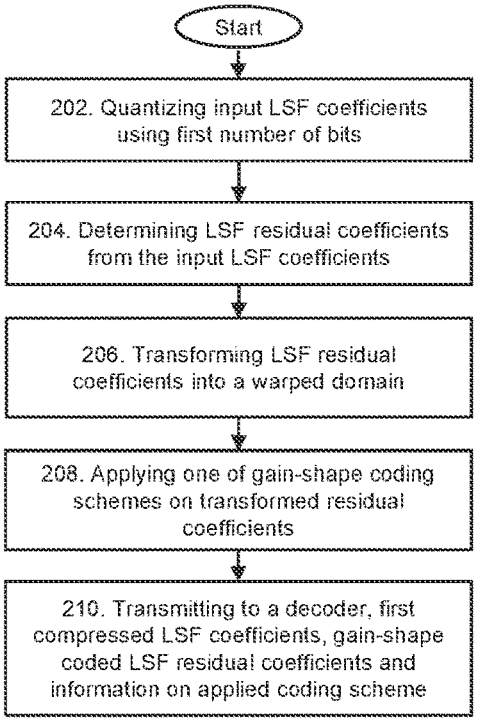
FIG. 4 illustrates an example of actions that may be performed by an encoder.

FIG. 4 is an illustrated example of actions or operations that may be taken or performed by an encoder, or by a transmitting unit comprising the encoder. In the disclosure, "the encoder" may correspond to "a transmitting unit comprising an encoder". The method of the example shown in FIG. 4 may comprise one or more of the following actions:

Action 202. Quantizing the input LSF coefficients using a first number of bits, resulting the first compressed LSF coefficients.

Action 204. Determining LSF residual coefficients, $LSF_{R2}$, as first compressed LSF coefficients subtracted from the input LSF coefficients.

Action 206. Transforming the LSF residual coefficients, $LSF_{R2}$, into a warped domain, resulting transformed LSF residual coefficient, $LSF_{R2T}$.

Action 208. Applying, one of a plurality of gain-shape coding schemes on the transformed LSF residual coefficients in order to achieve gain-shape coded LSF residual coefficients. The plurality of gain-shape coding schemes have mutually different trade-offs in one or more of gain resolution and shape resolution for one or more of the transformed LSF residual coefficients.

Action 210. Transmitting, over a communication channel to a decoder, the first compressed LSF coefficients, the gain-shape coded LSF residual coefficients, and information on the applied gain-shape coding scheme. As the compressed or coded parameters are represented by the indices set $\{i_L, i_H, i_{submode}, i_{gain}, i_{shapeO}/(i_{shapeA}, i_{shapeB})\}$ as will be discussed below, it can be said that representations of the first compressed LSF coefficients and the gain-shape coded LSF residual coefficients are transmitted over a communication channel.

Figure 5:
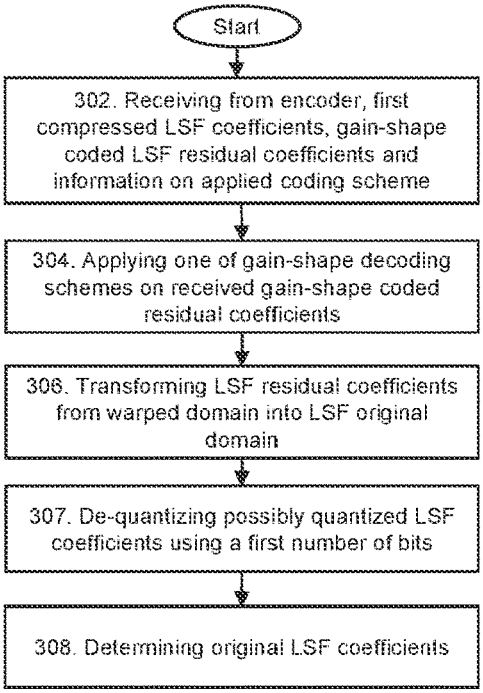
FIG. 5 illustrates an example of actions that may be performed by a decoder.

FIG. 5 is an illustrated example of actions or operations that may be taken or performed by a decoder, or by a receiving unit comprising the decoder. In the disclosure, "the decoder" may correspond to "a receiving unit comprising a decoder". The method of the example shown in FIG. 5 may comprise one or more of the following actions:

Action 302. Receiving, over a communication channel from an encoder, first compressed LSF coefficients, gain-shape coded LSF residual coefficients, and information on an applied gain-shape coding scheme, applied by the encoder.

Action 304. Applying, one of a plurality of gain-shape decoding schemes on the received gain-shape coded LSF residual coefficients according to the received information on applied gain-shape coding scheme, in order to achieve LSF residual coefficients. The plurality of gain-shape decoding schemes may have mutually different trade-offs in one or more of gain resolution and shape resolution for one or more of the gain-shape coded LSF residual coefficients.

Action 306. Transforming the LSF residual coefficients from a warped domain into an LSF original domain.

Action 308. Determining LSF coefficients as the transformed LSF residual coefficients added with the received first compressed LSF coefficients.

Action 307. De-quantizing possibly quantized LSF coefficients using a first number of bits similar to the number of bits used for quantizing LSF coefficients at a quantizer of the encoder.

According to another embodiment, the encoder performs the following steps:

Applies a low bit rate first stage quantizer to the LSFs resulting in first stage codewords. A lower bitrate requires smaller storage than a bitrate that is higher than the low bitrate. The LSFs may be mean, e.g. DC, removed LSFs.

Transforms the LSF-residual resulting from the application of the first stage quantizer to the LSFs to a warped domain, e.g. by applying Hadamard, Rotated DCT (RDCT) or DCT (Discrete Cosine Transform) transforms to the LSF-residual.

Selectively applies one of a plurality of submode gain-shape coding schemes on the LSF-residual, where the submode schemes have different tradeoffs in a) the gain resolution and b) the resolution for the shape of the coefficients, across the transformed LSF residual coefficients. The gain-shape submodes may use different resolution (in bits/coefficient) for different subsets. Examples of subsets {A/B}: {even+last}/{odd–last} Hadamard coefficients, RDCT{0-8,15} and RDCT{9-14}, DCT{0-8,15} and DCT{9-14}. An outlier mode may have one single full set of all the coefficients in the residual, whereas the regular mode may have several subsets, covering different dimensions with differing resolutions (bits/coefficient). According to an embodiment, the submode scheme selection is made by a combination of low complex Pyramid Vector Quantizer-, PVQ-projection and shape fine search selection followed by an optional global mean square error, MSE, optimization. The MSE optimization is global in the sense that both gain and shape and all submodes are evaluated. This saves average complexity. The step results in a submode index and possibly a gain codeword, and shape code word(s) for the selected submode. The selectively applying may be realized by searching an initial outlier submode and subsequently a non-outlier mode.

If available, the first stage vector quantizer (VQ) codewords of the applying step are sent over a communication channel to the decoder.

Information of the selected submode is transmitted over a communication channel to the decoder.

Gain codeword(s) achieved in the selectively applying step are indexed, and sent over a communication channel to the decoder, if required by the selected submode.

Shape PVQ codeword(s) achieved in the selectively applying step are indexed, and sent over a communication channel to the decoder.

By one or more of the embodiments of the invention one or more of the following advantages may be achieved:

Very low complexity can be achieved.

The application of a structured (energy compacting) transform allows for a strongly reduced first stage VQ. For example, the first stage VQ may be reduced to 25% of its original codebook size decreasing both Table ROM (Read Only Memory) and first stage search complexity. E.g. from R=0.875 bits/coefficient to R=0.625 bits per coefficient. E.g. with dimensions 8 one may drop from 8*0.875=7 bits to 8*0.625=5 bits, which corresponds to a drop from 128 vectors to 32 vectors of dimension 8.

The structured PVQ based sub-modes may be searched with an extended (low complex) linear search, even though there are several gain-shape combination sub-modes for the LSFs available.

The structured PVQ based sub-modes may be optimized to handle both outliers, where outliers are the LSF residuals with an atypical high and low energy, and also handle non-outlier target vectors with sufficient resolution.

In the following, an embodiment is presented. The proposed method requires as input a vector of LSF coefficients.

At the encoder, the following may be performed. First, LSF coefficients are obtained from the input signal representation, as $LSF_{in}$ e.g. by a known algorithm such as an algorithm described in EVS algorithmic specification 3GPP TS 26.445 v13.0.0 section 5.1.9 "Linear prediction analysis". Then an LSF global mean $LSF_{Mean}$ vector is subtracted from the input LSFs and this LSF global mean subtracted input LSF vector (denoted $LSF_{R1}$) is split into two parts, denoted as low ($L_{target}$) and high-frequency ($H_{target}$) parts. As an example for a 16 dimensional LSF vector, the first 8 coefficients may be used for the $L_{target}$ subvector and the remaining coefficients may be used for the $H_{target}$ subvector.

In an alternative implementation, the LSF vector might be converted to LSP (Line Spectral Pairs) or ISF (Immittance Spectral Frequencies) or ISP (Immittance Spectral Pairs) domain instead of LSFs. This will cause slight implementation variation, but the method steps, described in the following, apply to all these alternative representations.

The $L_{target}$ and $H_{target}$ target vectors are presented to a low rate first stage 8-dimensional VQ of eg. size 3-5 bits for each split. Two indices are obtained: $i_L$ an $i_H$. This is achieved by employing an MSE search, or a weighted MSE search of the stage 1 codebooks.

The complete LSF-residual after the first stage $LSF_{R2}$ is now computed as:

$$LSF_{R2}=[LSF_{in}]-[LSF_{mean}]-[L_{iL}\,H_{iH}],$$

$LSF_{R2}$ is transformed into a warped quantization domain using Hadamard, RDCT or DCT, resulting in the warped signal $LSF_{R2T}$. Hadamard, RDCT and DCT all have the capacity to compact energy, especially for LSF residual signals with a strong positive or negative DC-offset $LSF_{R2T}$ vector is presented to a memoryless (not employing frame error sensitive interframe prediction) stage 2 multimode PVQ based quantizer, resulting in a submode index $i_{mode}$, a gain index $i_{gain}$, indicating a gain applied for the whole vector, one or several PVQ shape indices $i_{shapeA}$, $\{i_{shapeB}\}$, where the shape indices together form a unit energy PVQ-vector $LSF_{R2T,en1}$ of size 16, in case of a 16 dimensional LSF vector.

The stage 2 vector quantizer also returns the gain values $g_{hat}$ and $GMEAN_{ST2}$ and the unit energy quantized and normalized LSF shape vector $LSF_{R2T,en1}$. $GMEAN_{ST2}$ is a global mean gain for the 2nd stage and $g_{hat}$ is an adjustment gain for fine scaling the $2^{nd}$ stage residual vector.

The shape vector $LSF_{R2T,en1}$ is warped back to the LSF domain using the Hadamard, the inverse RDCT, IRDCT, or the IDCT (inverse discrete cosine transform) transforms, to obtain an unwarped unit energy LSF-residual domain vector $LSF_{R2,en1}$.

The quantized LSFs are obtained as:

$$LSF_q=[LSF_{Mean}]+[L_{iL}H_{iH}]+g_{hat}*GMEAN_{ST2}*[LSF_{R2,en1}], \quad (2)$$

Here it is to be noted that the stage 1 split quantization may also be made in the transformed domain. However, there are a few complexity benefits of staying in the LSF/LSF residual domain for stage 1, as then individual LSF coefficient frequency dependent weighting may easily be applied to the stage 1 search, and further a non-transformed stage 1 will reduce the dynamic range of the residual signal to be transformed, so that the transform calculations may be applied using high enough precision with low complexity instructions.

Figure 6:
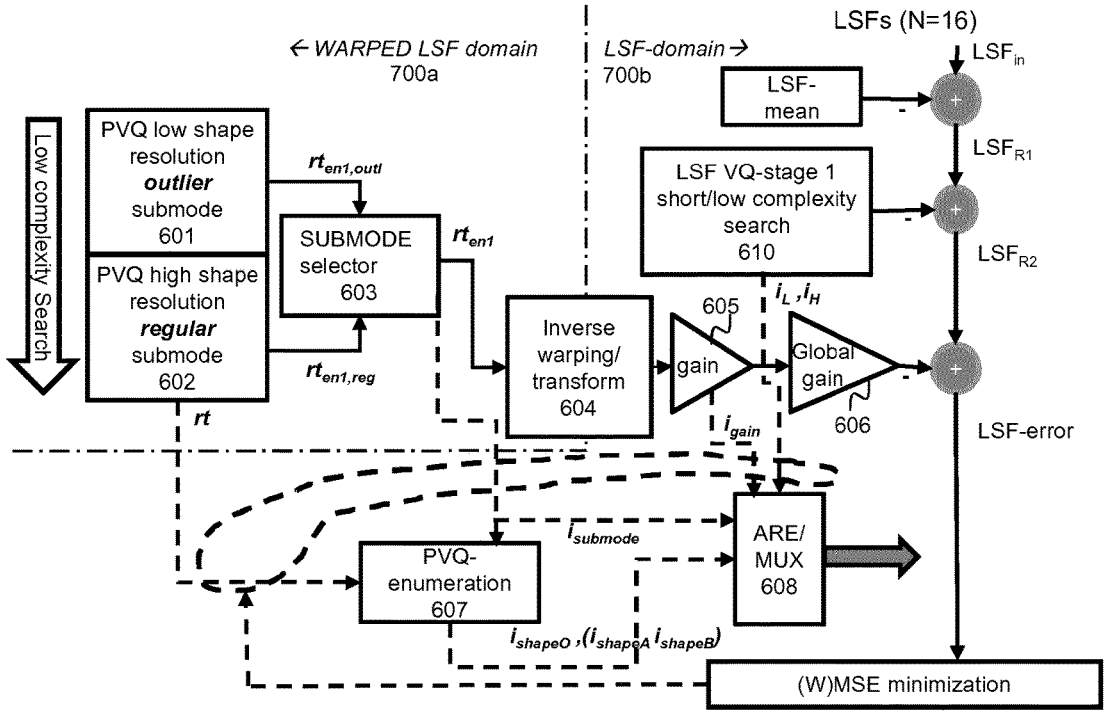
FIG. 6 illustrates an example of an LSF encoder.

FIG. 6 shows a possible high level LSF encoder analysis structure, for a low complexity quantization of the $LSF_{in}$ target vector, into the indices set $\{i_L, i_H, i_{submode}, i_{gain}, i_{shapeO}/(i_{shapeA}, i_{shapeB})\}$.

The $L_{target}$ and $H_{target}$ target vectors are presented to a low rate first stage VQ 610 to obtain two indices: $i_L$ an $i_H$.

The shape quantization is made in a warped/transformed domain 600*a*, using two spherical unit energy PVQ submodes: an outlier(outl) submode 601 and a regular(reg) submode 602, which have different shape resolution properties over different dimensions, but with sufficient similarities so that the regular finer resolution shape search may use the preliminary result of the lower shape resolution outlier submode shape search ($rt_{outl}$) to obtain $rt_{reg}$. These two integer vectors are searched by adding unit pulses, and after all the allowed unit pulses have been found, the integer vectors are normalized to (float) unit energy vectors $rt_{en1,outl}$ and $rt_{en1,reg}$, which are sent to the submode selector 603. The submode selector 603 acts as a switch and forwards either $rt_{en1,outl}$ or $rt_{en1,reg}$, as $rt_{en1}$ to the inverse warping block 604, depending on which submode (given by $i_{submode}$) being evaluated by the W(MSE) minimization block.

In the synthesis model the candidate shape vector is warped back to the LSF-residual domain 600*b* and scaled with a gain $g_{hat}$ given by a gain index $i_{gain}$, in a gain amplifier 605 (and possibly also by a global gain $G_MEAN_{ST2}$ in a global gain amplifier 606). In the actual optimized stage 2 search, the shape is searched in the warped LSF-domain, using an efficient PVQ-search. The final gain-shape minimization is preferably performed in the LSF-residual domain.

The global search uses MSE or WMSE minimization to find the best submode and gain combination resulting in a shape dem and the best gain $g_{hat}$ with index $i_{gain}$.

The integer vector rt of length N corresponding to the total selected unit energy shape $rt_{en1}$ is indexed by a PVQ enumeration scheme 607. In case of the outlier mode there is only one resulting PVQ-index, $i_{shapeO}$ and in case of the regular mode there are two resulting shape indeces $i_{shapeA}$ and $i_{shapeB}$. The dimension $N_x$ and number of unity pulses $K_x$ for each shape index is obtained by table lookup based on $i_{submode}$.

The set of LSF-indices $\{i_L, i_H, i_{submode}, i_{gain}, i_{shapeO}/(i_{shapeA}, i_{shapeB})\}$ are forwarded to a ARE/MUX (multiplexing) unit 608 which contains an arithmetic/range encoder (ARE) unit if fractional bits are used, and a regular bit level multiplexing unit if whole integer bits are employed for the set of LSF-indices. The thick arrow in the figure indicates the LSF indices being sent to the decoder.

At the decoder side, the following may be performed. The $LSF_{R2T,en1,dec}$ vector is obtained from the PVQ inverse quantizer using the submode index $i_{submode}$ and the PVQ-indexed shape indices $i_{shapeO}/\{i_{shapeA}, i_{shapeB}\}$.

The adjustment $gain_{hat,dec}$ is obtained from the index $i_{gain}$

The $LSF_{R2T,en1,dec}$ vector is warped to the LSF domain, to obtain the $LSF_{R2,en1,dec}$ vector.

First stage subvectors $L_{iL,dec}$ and $H_{iL,dec}$ are obtained from the stage 1 inverse VQ (codebook lookup), using indices $i_L$ and $i_H$.

The decoded LSF vector $LSF_{q,dec}$ is obtained as:

$$LSF_{q,dec}=[LSF_{mean}]+[L_{iL,dec}\ H_{iH,dec}]+ g_{hat,dec}*G_MEAN_{ST2}*[LSF_{R2,en1,dec}], \quad (3)$$

where the $[LSF_{mean}]$ vector and the $G_MEAN_{ST2}$ gain are constants stored in the decoder, e.g. at a Read Only Memory, ROM, of the decoder. Further, the vectors $L_{iL,dec}$ and $H_{iH,dec}$ may also be stored at the decoder, e.g. as ROM-tables.

Figure 7:
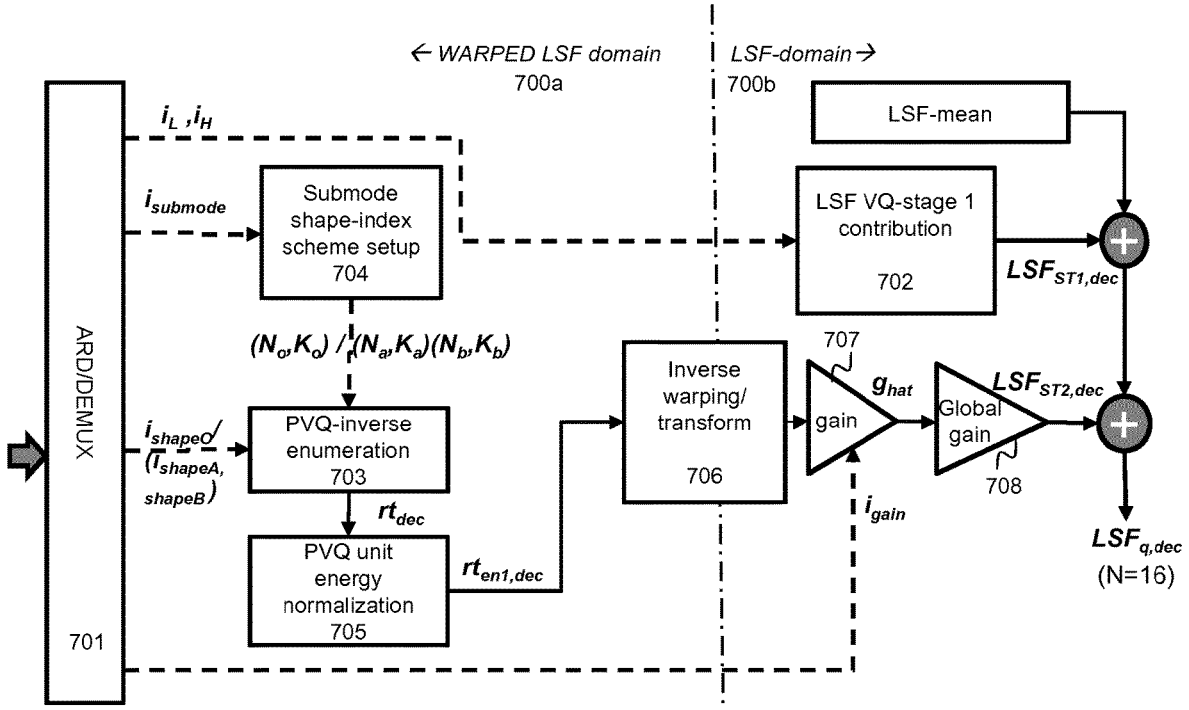
FIG. 7 illustrates an example of an LSF decoder.

FIG. 7 shows an embodiment of a schematic decoder. At the decoder, the set of LSF-indices $\{i_L, i_H, i_{submode}, i_{gain}, i_{shapeO}/(i_{shapeA}, i_{shapeB})\}$ are obtained (at the thick arrow) from the encoder at an ARD/DEMUX (demultiplexing) unit 701, which contains an arithmetic/range decoder (ARD) unit if fractional bits are used, and a regular bit level de-multiplexing unit if whole integer bits are employed for the set of LSF-indices.

The two stage 1 indices $i_L$, $i_H$ are decoded into the N dimensional vector $LSF_{ST1,dec}$ by table lookup 702.

The inverse enumerated/(deindexed) PVQ de-enumeration scheme 703 is applied to the shape indices as follows; in case of $i_{submode}$ indicating the outlier mode (when sub-mode shape-index scheme 704 is applied) the PVQ-index, $i_{shapeO}$ is de-indexed using dimension $N_o$ and $K_o$ unit pulses; in case $i_{submode}$ indicates the regular mode $i_{shapeB}$ are de-indexed using the (dimension, unit pulse) pairs $(N_a,K_a)(N_b, K_b)$, into the integer $N=N_a+N_b$ dimensional vector $rt_{dec}$. Subsequently the vector $rt_{dec}$ is normalized 705 into a unit energy shape vector $rt_{en1,dec}$.

The decoded shape vector $rt_{en1,dec}$ is warped 706 back from a warped/transformed domain 700*a* to the LSF-residual domain 700*b* and scaled 707 with a gain $g_{hat}$ given by a gain index $i_{gain}$. (and also scaled 708 by the global gain $G_MEAN_{ST2}$, if necessary) and stored as $LSF_{ST2,dec}$. Finally the quantized $LSF_{q,dec}$ vector is obtained by adding $LSF_{mean}$, $LSF_{ST1,dec}$ and the decoded stage 1 vector to $LSF_{ST2,dec}$.

In the following, a lower level detailed description of an embodiment is given.

Encoder Operation

Stage 1 search. The stored stage 1 codebooks LCbk and Hcbk each of size $N1*2^3$ values, (8 coefficients×N1 vectors per codebook) are searched in each target section L/H by using an MSE search.

$$err_{mse-st1L,i} = \sum_{n=0}^{7} (L_{target}(n) - 1.0 * Lcbk_i(n))^2, \quad (4)$$

$$i_L = \underset{0\le i\le 31}{\operatorname{argmin}}\, err_{mse-st1L,i}, \quad (5)$$

$$err_{mse-st1H,i} = \sum_{n=0}^{7} (H_{target}(n) - 1.0 * Hcbk_i(n))^2, \quad (6)$$

$$i_H = \underset{0\le i\le 31}{\operatorname{argmin}}\, err_{mse-st1H,i}, \quad (7)$$

Examples of off-line trained LSF-residual stage 1 codebooks Lcbk and Hcbk are given in further down (In the example, 38 bit case with 5 bit stage 1 codebooks case, N1 is $2^5$=32).

If the complexity requirement allows for it, the stage 1 codebook may also be searched with frequency dependent weights $w_n$:

$$err_{wmse-st1L,i} = \sum_{n=0}^{7} (w_n * (L_{target}(n) - 1.0 * Lcbk_i(n)))^2, \quad (8)$$

$$i_L = \underset{0\le i\le N1}{\operatorname{argmin}}\, err_{wmse-st1L,i}, \quad (9)$$

$$err_{wmse-st1H,i} = \sum_{n=0}^{7} (w_{n+8} * (H_{target}(n) - 1.0 * Hcbk_i(n)))^2, \quad (10)$$

$$i_H = \underset{0\le i\le N1}{\operatorname{argmin}}\, err_{wmse-st1H,i}, \quad (11)$$

Where $w_n$ may be a fixed vector addressing the human ear's lower sensitivity to high frequencies. E.g. $w_n$=[1 0.968 0.936 0.904 0.872 0.840 0.808 0.776 0.744 0.712 0.680 0.648 0.6160 0.584 0.552 0.520], or one may apply a more advanced weighting like IHM (Inverse Harmonic Mean).

Warping Transformation. The target stage2 LSF-residual is transformed to the warped domain using e.g. a Matrix operation, e.g. 16 by 16 matrix operation in case of 16 dimensional LSF vector.

RDCT Transform Application Example

Given R as the normalized RDCT matrix, and with an example:

$LSF_{R2}$ stage 2 target vector=[−7 −6 −5 −4 −3 −2 −1 0 1 2 3 4 5 6 7 8] (in this case a line with near zero mean), then $LSF_{R2T}=LSF_{R2}$,R becomes (forward transform)

$LSF_{R2T}$=[6.6691 −16.4483 5.0226 −0.8074 1.6795 −0.2607 0.3087 −0.2174 . . . 0.1582 −0.1421 0.0911 −0.0823 0.0505 −0.0432 0.0235 −0.0128]

Hadamard Transform Application Example

Given H as the normalized Hadamard matrix, and with an example $LSF_{R2}$ stage 2 target vector=[−7 −6 −5 −4 −3 −2 −1 0 1 2 3 4 5 6 7 8] (in this case a line with near zero mean), then $LSF_{R2T}=LSF_{R2H}$ becomes (forward transform)

$LSF_{R2T}$=[2 −2 −4 0 −8 0 0 0 −16 0 0 0 0 0 0 0]

DCT Transform Application Example

Given D as the normalized DCT matrix and with an example $LSF_{R2}$ stage 2 target vector=[−7 −6 −5 −4 −3 −2 −1 0 1 2 3 4 5 6 7 8] (in this case a line with near zero mean), then $LSF_{R2T}=LSF_{R2D}$ becomes (forward transform)

$LSF_{R2T}$=[2.0000 −18.3115 0.0000 −2.0075 −0.0000 −0.7016 0 −0.3395 . . . 0−0.1877 0−0.1071−0.0000−0.0560 0.0000−0.0175]

Stage 2 Gain-Shape Setup for Each Sub Mode.

The regular submode is a dimensional targeted high resolution mode, with reconstructions points on or close to a global long term average energy shell, given by the global gain $1.0*G_MEAN_{sT2}$, with energy $G_MEAN_{ST2}{}^2$. The regular mode has higher shape resolution than the outlier mode in a subset/section of given dimensions.

To further enhance the regular mode possibility to match the shape, it is made possible to zero all unit pulses in Subset/Section B (given by Table 1), this is indexed as the first index 0 in the PVQ-shape index for subset/section B.

Due to the unit pulse granularity of a PVQ-VQ, there may also be a possibility that the regular mode may use 2-4 additional gain levels. For the case of one or two additional bits available this code space is given to a gain adjustment index of the regular mode near 1.0. e.g. $[2^{-1/12}, 2^{1/12}]$ in case of 1 bit and $[2^{-2/24}\ 2^{-1/24}, 2^{1/24}, 2^{2/24}]$ in case of 2 bits. These levels are positioned between the neighbouring outlier energy shells, and the selection is made by MSE evaluation of the gain-shape combinations.

The outlier submode is an all-dimensional lower resolution mode, lower resolution in relation to the regular submode. The outlier submode has reconstruction points further away from the global long term average energy shell, given by the global gain $1.0*G_MEAN_{ST2}$, with energy $G_MEAN_{ST2}^2$. The outlier mode has the same shape resolution for all possible energy/gain shells, and it may correct errors equally well in all dimensions.

Regular Submode (38 Bit Example):

TABLE 1

Regular submode (38 bit example)

| Stage | First stage | Second stage | | | |
|---|---|---|---|---|---|
| Search Domain | LSF Residual domain | Warped/transformed LSF residual domain | | | |
| Parameter | Indices in first stage, 8 dimensional codebooks | Sub-mode $i_{submode}$ | Gain indices $i_{gain}$ for values $g_{hat}$ | Shape bits Section A RDCT/DCT indices {0-8, 15} Hadamard indices {0, 2, 4, 6, 8, 10, 12, 14 1, 15} | Shape bits Section B RDCT/DCT indices {9-14} Hadamard indices {3, 5, 7, 9, 11, 13} |
| Bit consumption | 2 × 5 bits | 1 (set to 1) | 1 bit values: $2.0^{[-1/12\ 1/12]}$ (regular values close to 1.0) | log2 (NPVQ($N_a$ = 10, $K_a$ = 10)) → 22.25 bits $K_a$ = 10 unit pulses over dimension $N_a$ = 10 $R_{shapeA}$ = 2.2 bits/coeff | log2 (NPVQ($N_b$ = 6, $K_b$ = 1) + 1) → 3.75 bits Kb = 1 unit pulses over dimension Nb = 6 $R_{shapeB}$ = 0.625 bits/coeff, where the "+1" above is needed to identify the all zero section B shape |
| Bit sum | 2 × 5 + 1 + 1 + 22.25 + 3.75 = 38 bits | | | | |

Outlier Submode (38 Bit Example):

TABLE 2

Outlier submode (38 bit example)

| Stage | First stage | Second stage | | |
|---|---|---|---|---|
| Search Domain | LSF Residual domain | Warped/transformed LSF residual domain | | |
| Parameter | Indices in first stage, 8 dimensional codebooks | Sub-mode $i_{submode}$ | Gain indices $i_{gain}$ for values $g_{hat}$ | Shape indices Spanning one section over all 16 coefficients |
| Bit consumption | 2 × 5 bits | 1 bit (set to 0) | 2 bits, values: $2.0^{[1,\ -1/3.1/3,1]}$ = [.5, .8, 1.25, 2.0] (outlier values far from 1.0) | log2(NPVQ(N = 16, $K_o$ = 8)) → 24.875 bits $K_o$ = 8 unit pulses over dimension N = 16 $R_{shape}$ = 1.55 bits per coefficient |
| Bit sum | 2 × 5 + 1 + 2 + 24.875 = 37.875 fractional bits = 38 whole bits | | | |

Regular Submode (42 Bit Example):

TABLE 3

Regular submode (42 bit example)

| Stage | First stage | Second stage | | | |
|---|---|---|---|---|---|
| Search Domain | LSF Residual domain | Warped/transformed LSF residual domain | | | |
| Parameter | Indeces in first stage 8 dimensional codebooks | Sub-mode $i_{submode}$ | Gain indeces $i_{gain}$ for values $g_{hat}$ | Shape bits Section A RDCT/DCT indices {0-7, 14-15} Hadamard indices {0, 2, 4, 6, 8, 10, 12, 14 13, 15} | Shape bits Section B RDCT/DCT indices {8-13} Hadamard indices {1, 3, 5, 7, 9, 11} |

TABLE 3-continued

| Regular submode (42 bit example) | | | | | |
|---|---|---|---|---|---|
| Stage | First stage | Second stage | | | |
| Bit consumption | 2 × 5 bits $R_{stage1}$ = 0.625 bits/coeff | 1 (set to 1) | 0 bit value: $2.0^0$ (regular values at the "1.0" unit energy/gain shell) | log2(NPVQ($N_a$ = 10, $K_a$ = 12)) → 24.375 bits $K_a$ = 12 unit pulses over dimension $N_a$ = 10 $R_{shapeA}$ = 2.43 bits/coefficient | log2(NPVQ($N_b$ = 6, $K_b$ = 2) + 1) → 6.25 bits $K_b$ = 2 unit pulses over dimension $N_b$ = 6 $R_{shapeB}$ = 1.04 bits/coefficient |
| Bit sum | 2 × 5 + 1 + 0 + 24.375 + 6.25 = 41.625 fractional bits = 42 whole bits | | | | |

Outlier Submode (42 Bit Example):

TABLE 4

| Outlier submode (42 bit example) | | | | |
|---|---|---|---|---|
| Stage | First stage | Second stage | | |
| Search Domain | LSF Residual domain | Warped/transformed LSF residual domain | | |
| Parameter | Indices in first stage 8 dimensional codebooks | Sub-mode $i_{submode}$ | Gain indices $i_{gain}$ for values $g_{hat}$ | Shape indices Spanning one section over all 16 coefficients |
| Bit consumption | 2 × 5 bits | 1 bit (set to 0) | 2 bit index, gain values: $2.0^{[-1, -1/3.1/3, 1]}$ = [.5, .8, 1.25, 2.0] (outlier values far from 1.0) | log2(NPVQ(N = 16, $K_o$ = 10)) → 28.625 bits $K_o$ = 10 unit pulses over dimension N = 16 $R_{shape}$ = 1.79 bits per coefficient |
| Bit sum | 2 × 5 + 1 + 2 + 28.625 = 41.625 fractional bits = 42 whole bits | | | |

Figure 8:
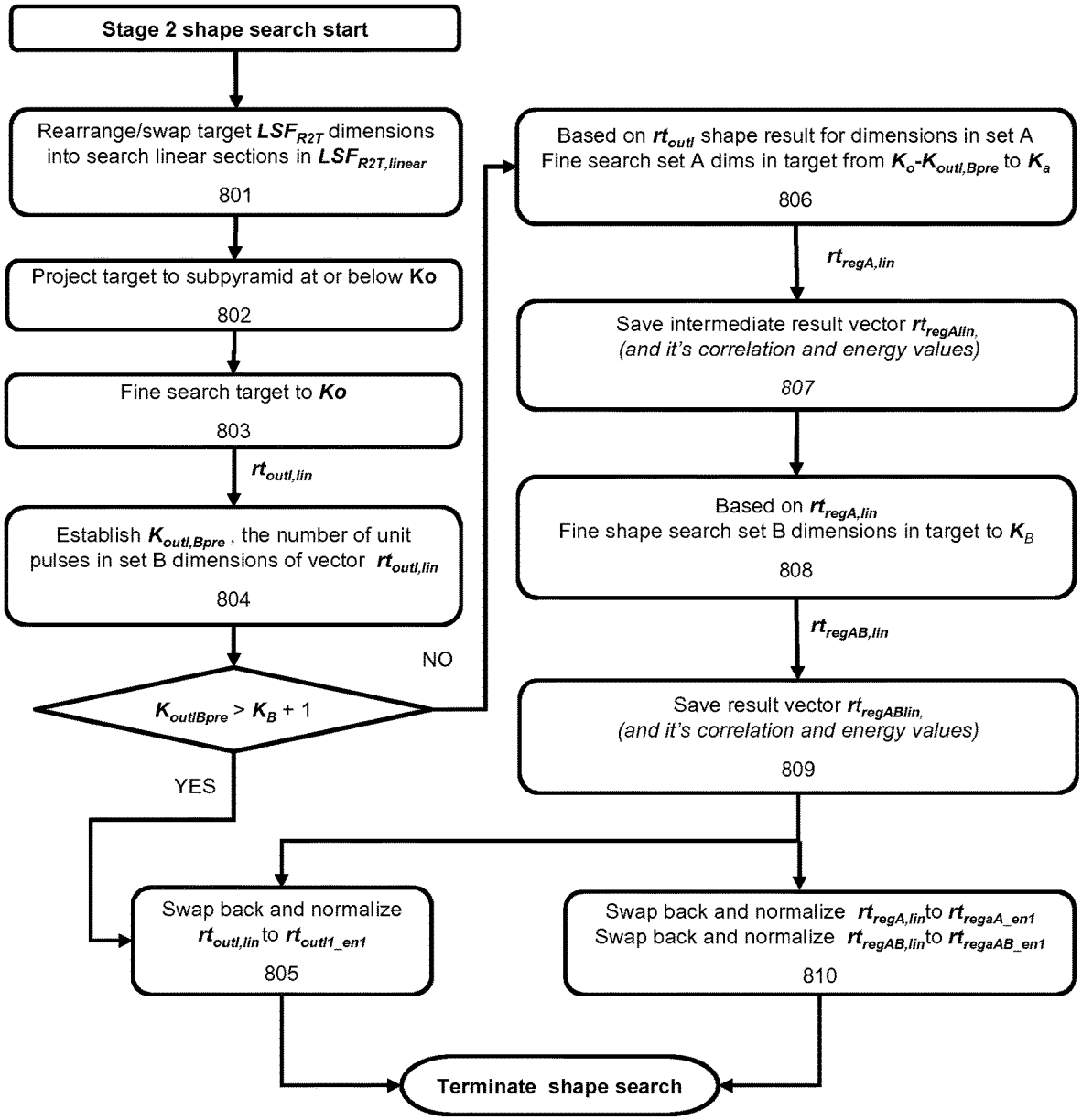
FIG. 8 is a flow chart illustration of an example embodiment of a stage 2 shape search flow.

Stage 2 Shape Search:

One may search each submode shape (the full 16 dimesional outlier section, regular section A, regular section B) using a complete PVQ shape search for that section, however to avoid several PVQ shape-searches for the various submodes in some cases. FIG. 8 is a flow chart showing an embodiment of a stage 2 shape search flow.

The stage 2 search may be performed by the following steps:

1) The coefficients in the $2^{nd}$ stage target, $LSF_{R2T}$ are rearranged to enable a fast linear shape search. The coefficients corresponding to non-linear sections of the regular sets {A, B} are arranged into high and low linear search sections, and a search target vector $LSF_{R2T,linear}$ is created (step 801 in FIG. 13). E.g. for the 38 bit LSF quantizer example sets {A, B} above, one may advantageously swap places between the target position 15 and target position 9. This enables a fast single unit pulse PVQ shape search loop, for target indices [0 . . . 8, 15], and [10-14, 9], without adding any complex non-linear lookup operations in the PVQ-search loop.
2) First, a legacy full dimensional PVQ-shape search for the target $LSF_{R2T,linear}$ is run, establishing $K_o$ unit pulses.
   a. This shape search may be done by a low cost projection (step 802), followed if required by a fine search (step 803), resulting in an integer vector $rt_{outl,lin}$ with integer pulses and a unit energy normalized vector $rt_{outl_en1norm,lin}$
   b. The number of unit pulses, i.e. the L1-norm, corresponding to the high section B of the regular mode are counted, in vector $rt_{outl,lin}$, resulting in a positive integer number $K_{outl,B,pre}$ (step 804).
3) Define a section B direction limit as $lim_B$=($K_B$+1).
   If the outlier shape search has produced too many pulses in the section B shape direction of the regular submode, (i.e. when $K_{outl,B,pre}$>=$lim_B$), the shape search may be discontinued and the outlier mode shape vector $out_{pre_en1norm,lin}$ will be used, together with a subsequently quantized gain factor (step 805).
4) If the shape search has produced a normal amount of pulses, or less pulses than $lim_B$, (i.e. $K_{outl,B,pre}$<$lim_B$), the stage2 shape search continues for the possible regular mode codepoints in these steps:
   a. Find the remaining unit pulses in set A (if any), using a PVQ shape search among the set A coefficients, start out this search from the ($K_o$−$K_{outl,B,pre}$) unit pulses among the set A coefficients as already established by the outlier shape search "step 2)" (step 806). The resulting vector $rt_{regA,lin}$, is of dimension 16, with all zero valued coefficients in the set B dimensions.
   b. Save the intermediate regular submode vector $rt_{regA,lin}$ with integer pulses, and prepare a corresponding unit energy normalized vector $rt_{regA_en1norm,lin}$, (this alternative regular shape vector may be used in cases where the addition of a one or few fixed number of pulses in the set B does not reduce the final gain-shape MSE error.) (step 807)
   c. Search for the $K_b$ pulses in set B by using a PVQ shape search among the set B coefficients, starting out from the integer vector, $rt_{regA,lin}$ and ending up with the integer vector $rt_{regAB,lin}$ (step 808)
   d. Save the total (sets {A and B}) regular sub mode vector as $rt_{regAB,lin}$ and prepare a corresponding unit energy normalized vector $rt_{regAB_en1norm,lin}$ (step 809).

At the end of the stage 2 shape search the section rearranged vectors $rt_{outl_en1norm,lin}$, $rt_{regAB_en1norm,lin}$, $rt_{regA_en1norm,lin}$ are arranged back to the original LSF differential domain coefficient order as $rt_{outl_en1norm}$, $rt_{regAB_en1norm}$, $rt_{regA_en1norm}$, and the corresponding coefficients in vectors $rt_{outl,lin}$, $rt_{regAB,lin}$ and $rt_{regA,lin}$ are arranged back into integer vectors $rt_{outl}$, $rt_{regAB}$ and $rt_{regA}$ (step 810).

E.g. for the 38 bit LSF quantizer, example sets {A, B} above it is now possible to swap places between the shape result position 15 coefficient and the shape result position 9 coefficient in the result vector(s), {$rt_{outl}$, $rt_{regAB}$ and $rt_{regA}$.}

The integer vectors $rt_{outl,lin}$, $rt_{regAB,lin}$ and $rt_{regA,lin}$ are saved to be able to easily enumerate these vectors into indices, using a PVQ-enumeration technique for subsequent transmission, which will be performed after the best available combination of a gain-value and a PVQ shape(s) option has been selected.

PVQ Shape Search Projection and PVQ Fine Search Equations.

This part may be seen as a generic description of a PVQ shape search including initial low cost projection and a pulse by pulse fine shape search.

The PVQ-coding concept was introduced by R. Fischer in the time span 1983-1986 (Fisher T. R.: "A pyramid vector quantizer", IEEE Transactions on information theory, vol. IT-32, no. 4, July 1986) and has evolved to practical use since then with the advent of efficient digital signal processors, DSPs. The PVQ encoding concept involves locating/searching and then enumerating a point on the N-dimensional hyper-pyramid with the integer L1-norm of K unit pulses. The L1-norm is the sum of the absolute values of the vector, i.e. the absolute sum of the signed integer PVQ vector is restricted to be K, where a unit pulse is represented by an integer value of "1".

One of the interesting benefits with the PVQ-coding approach in contrast to many other structured VQs is that there is no inherent limit to use a specific dimension N, so the search methods developed for PVQ-coding is applicable to any dimension N and to any K value.

For an L1-norm structured PVQ-quantizer an L1-norm of K for PVQ(N,K) signifies that the absolute sum of all elements in the PVQ-integer vector y(n) has to be K. The structured PVQ(N,K) allows for several search optimizations, where the primary optimization is to move the target to the all positive "quadrant" in N-dimensional space and the second optimization is to use an L1-norm projection to the pyramid neighborhood as a starting approximation for y(n), before entering into a fine search to reach K.

A third optimization is to iteratively update the $Q_{PVQ}$ quotient terms, instead of re-computing Eq. 15 below over the whole vector space N, for every evaluated change to the vector y(n) in pursuit of reaching the L1-norm K, where an exact K is required for the subsequent PVQ-enumeration step.

Unit Energy Normalized PVQ-Shape Search Introduction.

The goal of the PVQ(N,K) shape search procedure is to find the best scaled and unit energy normalized vector $x_q(n)\cdot x_q(n)$ is defined as:

$$x_q=\frac{y}{\sqrt{y^T y}} \tag{12}$$

where $y=y_{N,K}$ is a point on the surface of an N-dimensional hyper-pyramid and the L1 norm of $y_{N,K}$ is K. I.e. $y_{N,K}$ is the selected integer shape code vector of size N according to:

$$y_{N,K} = \left\{ e : \sum_{i=0}^{N-1} |e_i| = K \right\} \tag{13}$$

I.e. $x_q$ is the unit energy normalized integer sub vector $y_{N,K}$.

The best integer shape y vector is the one minimizing the mean squared shape error between the target vector x(n) and the scaled unit energy normalized quantized output vector $x_q$. This is achieved by minimizing the following shape distortion:

$$d_{PVQ} = -x^T x_q = -\frac{(x^T y)}{\sqrt{y^T y}} \tag{14}$$

or equivalently maximizing the quotient $Q_{PVQ}$, e.g. by squaring numerator and denominator:

$$Q_{PVQ} = \frac{(x^T y)^2}{y^T y} = \frac{(corr_{xy})^2}{energy_y} \tag{15}$$

where $corr_{xy}$ is the correlation between target x and PVQ integer vector y. In the search of the optimal PVQ vector shape for integer vector y(n) with L1-norm K, iterative updates of the $Q_{PVQ}$ variables are made in the all positive "quadrant" in N-dimensional space according to:

$$corr_{xy}(k,n)=corr_{xy}(k-1)+1\cdot x(n) \tag{16}$$

$$energy_y(k,n)=energy_y(k-1)+2\cdot 1^2-y(k-1,n)+1^2 \tag{17}$$

where $corr_{xy}(k-1)$ signifies the correlation achieved so far by placing the previous k−1 unit pulses, and $energy_y(k-1)$ signifies the accumulated energy achieved so far by placing the previous k−1 unit pulses, and y(k−1, n) signifies the amplitude of y at position n from the previous placement of k−1 unit pulses. To allow flexible dynamic scaling of the energy denominator, an optional temporary inloop energy value $enloop_y(k,n)$ may be used instead of $energy_y(k,n)$ (Eq. 17) and thus for $energy_y$ in (Eq. 15) however in this description they have the same value.

$$Q_{PVQ}(k, n) = \frac{corr_{xy}(k, n)^2}{enloop_y(k, n)} \tag{18}$$

In the fine shape search the best position $n_{best}$ for the k'th unit pulse, is iteratively updated by increasing n linearly from 0 to N−1:

$$n_{best}=n, \text{ if } Q_{PVQ}(k,n)>Q_{PVQ}(k,n_{best}) \tag{19}$$

To avoid costly divisions, which is especially important in fixed point arithmetic, the $Q_{PVQ}$ maximization update decision is performed using a cross-multiplication of the saved best squared correlation numerator bestCorrSq and the saved best energy denominator bestEn so far.

$$\left.\begin{aligned} n_{best} &= n \\ bestCorrSq &= corr_{xy}(k, n)^2 \\ bestEn &= enloop_y(k, n) \end{aligned}\right\}, \tag{20}$$

$$\text{if } corr_{xy}(k, n)^2 \cdot bestEn > bestCorrSq \cdot enloop_y(k, n)$$

The iterative maximization of $Q_{PVQ}(k, n)$ may start from a zero number of placed unit pulses or from an adaptive lower cost pre-placement number of unit pulses, based on a projection to a point on or below the K'th-pyramid's surface, with a guaranteed hit or undershoot of unit pulses in the target L1 norm K.

PVQ Pre-Search Projection.

A low cost projection to the K or K−1 sub pyramid may be made and used as a starting point for y. This will save the number of operations an iterative fine PVQ-search will need to perform to reach K. The low cost projection to "K" or slightly lower than K is typically less computationally expensive in DSP cycles than repeating an iterative unit pulse inner loop test (Eq 20) N*K times, however there is a drawback with the low cost projection that it may produce an inexact result due to the use of a non-linear N-dimensional floor application. The resulting L1-norm of the low cost projection may typically be anything between "K" to roughly "K−4", i.e. the result after the projection usually needs to be fine searched to reach the required target L1-norm of K.

The low cost projection may be performed as:

$$proj_{fac} = \frac{K}{\sum_{n=0}^{n=N-1} xabs(n)} \tag{21}$$

$$y(n) = y_{start}(n) = \lfloor xabs(n) \cdot proj_{fac} \rfloor, \quad \text{for } n = 0 \ldots N-1 \tag{22}$$

In preparation for the fine search to reach the K'th-pyramid's surface, the accumulated number of unit pulses $pulse_{tot}$, the accumulated correlation $corr_{xy}(pulse_{tot})$ and the accumulated energy $energy_y(pulse_{tot})$ for the starting point is computed as:

$$pulse_{tot} = \sum_{n=0}^{n=N-1} y(n) \tag{23}$$

$$corr_{xy}(pulse_{tot}) = \sum_{n=0}^{n=N-1} y(n) \cdot xabs(n) \tag{24}$$

$$energy_y(pulse_{tot}) = \sum_{n=0}^{n=N-1} y(n) \cdot y(n) = \|y\|_{L2} \tag{25}$$

$$enloop_y(pulse_{tot}) = energy_y(pulse_{tot}) \tag{26}$$

PVQ Fine Shape Search.

The final integer shape vector y(n) of dimension N should adhere to the L1 norm of K pulses. The fine search starts from a lower point in the pyramid and iteratively finds its way to the surface of the N-dimensional K'th hyperpyramid. The K-value in the fine search can typically range from 1 to 512 unit pulses. I.e. by employing (Eq. 20) until the desired L1-norm of K has been reached.

PVQ Shape-Vector Finalization and Normalization.

After the fine shape search each non-zero PVQ-sub-vector element is assigned its proper sign and the $x_q(n)$ vector is L2-normalized to unit energy.

$$\text{if}(y(n) > 0) \cap (x(n) < 0) \Rightarrow y(n) = -y(n), \quad \text{for } n = 0, \ldots, N-1 \tag{27}$$

$$norm_{gain} = \frac{1}{\sqrt{y^T y}} \tag{28}$$

$$x_q(n) = norm_{gain} \cdot y(n), \text{ for } n = 0, \ldots, N-1 \tag{29}$$

Inverse Transform.

The obtained shape vectors $rt_{outl_en1norm}$, $rt_{regAB_en1norm}$, $rt_{regA_en1norm}$ are transformed back to the unwarped domain by applying the inverse warping/transform. In case of RDCT ("R") the inverse RDCT, RIDCT("$R^T$") is applied, in case of DCT ("D"), the inverse DCT, IDCT ("$D^T$") is applied. I.e. here we make use of the fact that $R \cdot R^T = I$ and $D \cdot D^T = I$, in matrix notation, where I is the identity matrix. In case of the second stage LSF residual quantizer using Hadamard, the Hadamard transform (H) is applied again, making use of the fact that H·H=I in matrix notation.

The resulting unwarped vectors in the LSF residual domain are called $r_{outl_en1norm}$, $r_{regAB_en1norm}$ and $r_{regA_en1norm}$. In case the shape search was discontinued after determining $rt_{outl_en1norm}$, only the vector $r_{outl_en1norm}$, will need to be transformed into the LSF residual domain, saving average complexity when outlier vectors are identified early in the search process.

Inverse RDCT Transform Application Example

Given R as the normalized RDCT matrix and with an example unit energy stage 2 vector,
$rt_{en1}$=[6.6691 −16.4483 5.0226 −0.8074 1.6795 −0.2607 0.3087 −0.2174 . . . 0.1582−0.1421 0.0911−0.0823 0.0505−0.0432 0.0235−0.0128]/($344^{0.5}$)
then $LSF_{R2,en1} = rt_{en1} \cdot R^T$ becomes (inverse warping, IRDCT)
$LSF_{R2,en1}$=[−0.3774 −0.3235 −0.2696 −0.2157 −0.1617 −0.1078 −0.0539 0.0000 0.0539 0.1078 0.1617 0.2157 0.2696 0.3235 0.3774 0.4313]

Inverse Hadamard Transform Application Example

Given H as the normalized Hadamard matrix, and with an example stage 2 unit energy normalized vector
$rt_{en1}$=[2 −2 −4 0 −8 0 0 0 −16 0 0 0 0 0 0 0] ($344^{0.5}$),
then $LSF_{ST2,en1} = rt_{en1} \cdot H$ becomes (inverse warping as HH=I)
$LSF_{R2,en1}$=[−0.3774 −0.3235 −0.2696 −0.2157 −0.1617 −0.1078 −0.0539 −0.0000 0.0539 0.1078 0.1617 0.2157 0.2696 0.3235 0.3774 0.4313]

Inverse DCT Transform Application Example

Given D as the normalized DCT matrix and with an example unit energy stage 2 vector
$rt_{en1}$=[2.0000 −18.3115 0.0000 −2.0075 −0.0000 −0.7016 0 −0.3395 0 −0.1877 0 −0.1071 −0.0000 −0.0560 0.0000 −0.0175]/($344^{0.5}$)
then $LSF_{R2,en1} = rt_{en1} \cdot D^T$ becomes (inverse warping DCT)
$LSF_{R2,en1}$=[−0.3774 −0.3235 −0.2696 −0.2157 −0.1617 −0.1078 −0.0539 0.0000 0.0539 0.1078 0.1617 0.2157 0.2696 0.3235 0.3774 0.4313]

Stage 2 Final Shape and Gain Determination in the LSF Residual Domain.

A Weighted MSE determination is made to determine the best quantized stage 2 LSF residual vector $g_{i_best_comb}$*$GMEAN_{ST2}$*[$r_{st2,i_be_st_comb}$] among the available scalar gain-factors and the available shape-vector alternatives.

$$err_{wmse,i_comb} = \Sigma_{n=0}^{15} (w_n)^2 ([LSF_{R2}(n)] - g_{i_{comb}} * GMEAN_{ST2} * [r_{st2,i_comb}(n)])^2 \tag{30}$$

the allowed gain shape combinations are made up of the allowed gain and shape combinations. Further it should be noted that by setting all the weights $w_n$ to 1.0 one will get the MSE criterion. E.g. for the 38 bit LSF-residual quantizer setup the following set of eight combinations are evaluated.

TABLE 5

Available gain shape combinations in LSF-residual domain for the 38 bit example LSF-stage 2 algorithmic VQ.

| Gain-shape search combination index $i_{comb}$ | Gain candidate $g_i$ | Candidate shape $[r_{st2,i}]$ | Submode index $i_{submode}$ (0 = outlier, 1 = regular) | gain index $i_{gain}$ | Set {B} 'PVQ' shape index $I_{shape,B}$ | Combination/shell description |
|---|---|---|---|---|---|---|
| 0 | $2^{-1}$ | $[r_{outl_en1norm}]$ | 0 | 0 | n/a | Low energy outlier shell |
| 1 | $2^{-1/3}$ | $[r_{outl_en1norm}]$ | 0 | 1 | n/a | Quite low energy outlier shell |
| 2 | $2^{1/3}$ | $[r_{outl_en1norm}]$ | 0 | 2 | n/a | Quite high energy outlier shell |
| 3 | $2^{1}$ | $[r_{outl_en1norm}]$ | 0 | 3 | n/a | High energy outlier shell |
| 4 | $2^{-1/12}$ | $[r_{regAB_en1norm}]$ | 1 | 0 | >0 | Regular/nominal energy shell both set {A, B} |
| 5 | $2^{1/12}$ | $[r_{regAB_en1norm}]$ | 1 | 1 | >0 | Regular/nominal shell both set {A, B} |
| 6 | $2^{-1/12}$ | $[r_{regA_en1norm}]$ | 1 | 0 | 0 | Regular/nominal shell only set {A} |
| 7 | $2^{1/12}$ | $[r_{regA_en1norm}]$ | 1 | 1 | 0 | Regular/nominal shell only set {A} |

Note that this evaluation can be performed in a closed search loop over all allowed combination alternatives ($i_{comb}$), resulting in an index $i_{best_comb}$, indicating the combination with the lowest mean square error.

However, one may, alternatively, first establish the best quantized gain alternative for each shape of the three shape alternatives ($[r_{outl_en1norm}]$, $[r_{regAB_en1norm}]$, $[r_{regA_en1norm}]$), and then determine the minimum weighted MSE, WMSE, among the then three remaining gain-shape options according to the $err_{WMSE}$ equation above.

After the encoder side WMSE or MSE minimization the following assignments are made:

$$g_{hat}=g_{i_best_comb}$$

$$LSF_{R2,en1}=r_{st2,i_best_comb}$$

Further, $I_{submode}$, $I_{gain}$ and $I_{shape,B}$ are set corresponding to the established $I_{best_comb}$ Stage 2 Shape and Gain Determination in the Warped LSF Residual Domain.

Another complexity-wise attractive alternative to establish $g_{hat}$ and $LSF_{R2,en1}$ is to evaluate the possible gain-shape combination in the warped domain as this will then only require one transformation of one single selected best gain-shape combination. The drawback is that the weights $w^n$ will no longer represent a single frequency point in the LSF-residual domain, for that reason all the weights may be set to 1.0 in a lowest complexity solution.

$$err_{t\text{-}wmse,i_comb}=\Sigma_{n=0}^{15}(w_n([LSF_{RT2}(n)]-g_{i_{comb}}GMEAN_{ST2}[rt_{st2,i_comb}(n)])) \quad (1)$$

After the selection of $i_{best_comb}$ based on $err_{t\text{-}wmse,i_comb}$ the warped domain vector $rt_{st2,i_comb}$ is warped back to the unwarped LSF-residual domain by applying the IRDCT, IDCT or Hadamard, resulting in $r_{st2,i_best_comb}$. The table 6 shows the gain-shape combinations for a warped domain (W)MSE search in the 38 bit example case.

TABLE 6

Available gain shape combinations in the warped LSF-residual domain for the 38 bit example LSF-stage 2 algorithmic VQ.

| Gain-shape search combination index $i_{comb}$ | Gain candidate $g_i$ | Candidate warped shape $[rt_{st2,i}]$ | Submode index $i_{submode}$ (0 = outlier, 1 = regular) | gain index $i_{gain}$ | Set {B} 'PVQ' shape index $I_{shape,B}$ | Combination/shell description |
|---|---|---|---|---|---|---|
| 0 | $2^{-1}$ | $[r_{outl_en1norm}]$ | 0 | 0 | n/a | Low energy outlier shell |
| 1 | $2^{-1/3}$ | $[rt_{outl_en1norm}]$ | 0 | 1 | n/a | Quite low energy outlier shell |
| 2 | $2^{1/3}$ | $[rt_{outl_en1norm}]$ | 0 | 2 | n/a | Quite high energy outlier shell |
| 3 | $2^{1}$ | $[rt_{outl_en1norm}]$ | 0 | 3 | n/a | High energy outlier shell |
| 4 | $2^{-1/12}$ | $[rt_{regAB_en1norm}]$ | 1 | 0 | >0 | Regular/nominal energy shell both set {A, B} |
| 5 | $2^{1/12}$ | $[rt_{regAB_en1norm}]$ | 1 | 1 | >0 | Regular/nominal shell both set {A, B} |
| 6 | $2^{-1/12}$ | $[rt_{regA_en1norm}]$ | 1 | 0 | 0 | Regular/nominal shell only set {A} |
| 7 | $2^{1/12}$ | $[rt_{regA_en1norm}]$ | 1 | 1 | 0 | Regular/nominal shell only set {A} |

Synthesis of the Final Quantized LSF-Vector $LSF_g$.

The quantized LSF vector is obtained by combining the mean vector, the stage 1 contribution and a scaled unit energy stage 2 contribution.

$$LSF_q=[LSF_{Mean}]+[L_{iL}\ H_{iH}]+g_{hat}*GMEAN_{ST2}*[LSF_{R2,en1}]$$

In the decoder FIG. 8 one may identify that $[L_{iL}\ H_{iH}]$ corresponds to $LSF_{st1,dec}$, and $g_{hat}*GMEAN_{ST2}*[LS_{FR2,en1}]$ corresponds to $LSF_{st2,dec}$, and that the warped back version of the unit energy vector $rt_{en1,dec}$, corresponds to $LSFR_{2,en1}$.

Enumeration of the PVQ Integer Vectors into Shape Indices.

In case of the outlier mode, the integer vector $rt_{outl,lin}$, is enumerated into an index $I_{shape,outl}$, using known PVQ-enumeration techniques, such as the computationally efficient Modular PVQ enumeration scheme, MPVQ-scheme, described below, or possibly a variation of Fischer's original PVQ-enumeration.

In case the regular submode is selected, the 16 dimensional integer vector $rt_{regAB,lin}$ or $rt_{regA,lin}$ is enumerated into two PVQ-indices $I_{shape,A}$, $I_{shape,B}$, using known PVQ-enumeration techniques, such as the computationally efficient MPVQ-scheme described below, or possibly a variation of Fischer's original enumeration.

In case only the first set of coefficients A is to be transmitted, e.g. when $i_{comb}$ is 6 or 7 in the 38 bit example above, the $I_{shape,B}$ Index is set to 0, and no PVQ enumeration for the second set of coefficients B takes place. $I_{shape,A}$ is obtained by PVQ-enumerating the set A coefficients in $rt_{regA,lin}$.

In case both sets of coefficients {A, B} are to be transmitted, e.g. when $i_{comb}$ is 4 or 5 in the 38 bit example above, the $I_{shape,B}$ index is initially obtained by PVQ-enumerating the set B coefficients in $rt_{regAB,lin}$. Following this enumeration, an offset of 1 is added to $I_{shape,B}$ to make code space for the all zero B-shape. An "all zero" means no shape at all for the set B points, i.e. when zeroed the second set of coefficients B do not have any energy, nor any shape/direction.

The $I_{shape,A}$ index is obtained by PVQ-enumerating the set A coefficients in $rt_{regAB,lin}$.

Example PVQ enumeration scheme: MPVQ short codeword enumeration of integer vector $Z_{N,K}$ The $z_{N,K}$ integer vector with dimension N and an L1-norm of K, where K is K unit pulses, may be enumerated using a method that divides the PVQ shape index into two shorter codewords which are composed as follows:

a first codeword representing the first sign encountered in the integer vector independent of its position;

a second codeword representing, in a recursive fashion, all the remaining pulses in the remaining vector which is now guaranteed to have a leading positive pulse. The second codeword is enumerated using the recursive structure displayed in Table 7 below. The recursive structure defines an U(N,K)offset matrix and enables the recursion computations to stay within the B−1 dynamics of a B bits signed integer.

TABLE 7

Modular-PVQ (MPVQ) enumeration structure

| Lead value | Section size | Section definition |
|---|---|---|
| K | 1 | The all pulses consumed case; zeroes in remaining dimensions |

TABLE 7-continued

Modular-PVQ (MPVQ) enumeration structure

| Lead value | Section size | Section definition |
|---|---|---|
| K − 1 . . . 1 | 2 · U (N, K) | All initial pulse amplitude cases with a subsequent new leading sign, (positive or negative). |
| 0 . . . 0 | $N_{MPVQ}$ (N − 1, K) | The no initial pulse consumed cases; the current leading sign is kept for the next dimension. |

From Table 7 it can be seen that the total number of entries, with the very first leading sign information removed, can be expressed as:

$$N_{MPVQ}(N,K)=1+2\cdot U(N,K)+N_{MPVQ}(N-1,K) \tag{32}$$

Combining (32) with Fischer's original PVQ-recursion, the total number of entries can be expressed as:

$$N_{MPVQ}(N,K)=1+U(N,K)+U(N,K+1) \tag{33}$$

Runtime computed or stored values of the U(N,K) matrix may now be used as the basis for the MPVQ-enumeration and the update of the symmetric U matrix from row N−1 to row N can be performed as:

$$U(N,K+1)=1+U(N-1,K)+U(N-1,K+1)+U(N,K), \tag{34}$$

with initial conditions, U(N,0)=U(N,1)=U(0,K)=U(1,K)=0.

The two short MPVQ codewords may now be combined into a joint PVQ-index indexd, ($index_{shape}$,=codeword(1)+2*codeword(2)), a PVQ index which is uniquely decodable to the integer vector $Z_{N,K}$.

The bits that are to be transmitted are, in the embodiment, first sent to a multiplexing unit of the encoder where the bits are multiplexed. Thereafter, the multiplexed bits are transmitted over a communication channel to the decoder.

Stage 1 indices $i_L$ and $i_H$, are sent to the multiplexing unit. It is noted that the $[LSF_{Mean}]$ vector, i.e. the long term average LSF coefficient vector, is not transmitted, it is stored in a ROM in both the encoder an the decoder.

If the selected submode is the regular submode, a single bit with value 1 is transmitted to the multiplexing unit. This is for the exemplary embodiment where there are only two submodes to select from: a regular submode and an outlier submode. If there are more than two submodes to select from, a corresponding number of bits are needed.

If the selected submode is the outlier submode, a single bit with value 0 is transmitted to the multiplexing unit. Of course it may also be the opposite, i.e. a 1 is transmitted when the outlier submode is selected and a 0 is transmitted when the regular submode is selected. Anyhow, the decoder needs to know in advance the interpretation of a "0" and a "1".

The fine gain index $i_{gain}$ (see Table 5) corresponding to the determined fine gain $g_i$ is sent to the multiplexing unit. It is noted that the value $GMEAN_{ST2}$, i.e. the long term average stage 2 gain, is in this embodiment not transmitted, it is stored in ROM in both encoder an decoder.

The integer pulse vector (rt in FIG. 7) corresponding to the selected best combination have been forwarded to a PVQ-enumeration unit. The PVQ enumeration unit may e.g. use the efficient MPVQ enumeration as in [EVS 3GPP TS26.445 v13.0.0 sections 5.3.4.2.7.4 "PVQ short codeword indexing" and 6.2.3.2.6.3 "PVQ sub-vector MPVQ de-indexing"].

For the outlier mode there is, in one embodiment, one shape index to transmit $I_{shape,outl}$ The number of possible values for $I_{shape,outl}$ is given by $SIZE_{shape,outl}$=NPVQ(N=16,K=Ko) preferably stored in ROM.

For example, for the 38 bit case, N is 16 and Ko is 8, which results in a PVQ total dimension of NPVQ(16,8)=30316544, i.e. $SIZE_{shape,outl}$=30316544.

In the case there is an arithmetic or range encoder that supports fractional bit resolution available in the encoder, the value of $I_{shape,outl}$ and the size parameter $SIZE_{shape,outl}$, are forwarded to the arithmetic (or range) encoder, for multiplexing into the bit-stream. The arithmetic/range encoder may use a uniform Probability Density Function, PDF, to encode the shape index.

In the case no arithmetic or range encoder is available in the encoder, the index $I_{shape,outl}$, is sent to the multiplex unit and multiplexed using ceil(log 2($SIZE_{shape,outl}$)) bits, (25 bits in the 38 bit example)

For the regular mode there are two shape indices to transmit $I_{shapeA}$ and $I_{shapeB}$.

The number of possible values for of $I_{shapeA}$ is given by $SIZE_{shapeA}$=NPVQ($N_a$=10,K=$K_a$), preferably stored in the ROM. The number of possible values for of $I_{shapeB}$ is given by $SIZE_{shapeB}$=1+NPVQ($N_b$=6,K=$K_b$), preferably stored in the ROM.

For example, for the 38 bit case, Na is 10 and $K_a$ is 10, which results in a PVQ total dimension of NPVQ(10,10)=4780008 i.e. $SIZE_{shapeA}$=4780008, and $N_b$ is 6 and $K_b$ is 1, which results in a PVQ total dimension of 1+NPVQ(6,1)=1+12, i.e. $SIZE_{shapeB}$=12+1=13.

In the case there is an arithmetic or range encoder that supports fractional resolution available in the encoder, the values of shape indices $I_{shape,A}$, $I_{shape,B}$ and the size parameters $SIZE_{shapeA}$ $SIZE_{shapeB}$ are forwarded to the arithmetic (or range) encoder, for multiplexing into the bit-stream. The arithmetic/range encoder may use a uniform PDF to encode these shape indices.

In the case no arithmetic or range encoder is available, the index $I_{shape,A}$ is sent to the multiplex unit and multiplexed using ceil(log 2($SIZE_{shapeA}$)) bits, (23 bits in the 38 bit example).

In the case no arithmetic or range encoder is available the index $I_{shape,B}$ is sent to the multiplex unit and multiplexed using ceil(log 2($SIZE_{shapeB}$)) bits, (4 bits in the 38 bit example).

Table 8 gives on overview of encoded bits as sent to the multiplexing unit, for the 38 bit example.

Decoder Operation

In general the decoder performs a submode index $i_{submode}$, guided operations of the encoder results, to end up with the quantized LSFs (denoted $LSF_q$), as the required information for constructing the quantized LSFs has been transmitted from the encoder to the decoder, for example as indices.

Receiving and De-Multiplexing the Bits into Signals.

1. The decoder obtains $i_L$, $i_H$, $i_{submode}$, $i_{gain}$, $i_{shapeOutl}$/($i_{shapeA}$, $i_{shapeB}$) over a communication channel from the decoder. If $i_{submode}$ indicates that outlier mode is used, $i_{shapeOutl_}$ is sent, If $i_{submode}$ indicates that regular mode is used, $i_{shapeA}$, $i_{shapeB_}$ is sent. The obtained data is received at an input unit, which may be a de-multiplexing unit of the decoder.
2. The decoder obtains $i_L$ and $i_H$ from the demultiplexing unit, and decodes the first stage codewords $i_L$ and $i_H$ into vectors [$L_{iL}$ $H_{iH}$] using e.g. conventional table lookup.
3. The decoder obtains $i_{submode}$ from the de-multiplexing unit
   a. in case $i_{submode}$ is 0, it is an indication to the decoder that the outlier submode was used by the encoder. Then the outlier submode decoding steps of the decoder are followed:
      i. gain index $i_{gain}$ is obtained from the de-multplexing unit and decoded into gain value $g_{hat}$;
      ii. shape index $i_{shape,outl}$ is obtained from the de-multiplexing unit, or from an arithmetic/range decoder unit;
      iii. A PVQ inverse enumeration module, e.g. an MPVQ-scheme decoder converts the shape index $i_{shape,outl}$ into a PVQ integer vector $rt_{lin}$ of length N with L1-norm $K_o$;
      iv. Vector $rt_{lin}$ is re-sorted into the LSF-residual domain order as rt.
   b. in case $i_{submode}$ is 1, it is an indication to the decoder that the regular submode was used by the encoder. Then the regular submode decoding steps are followed:
      i. gain index $i_{gain}$ is obtained from the demultiplexing unit and decoded into gain value $g_{hat}$;
      ii. the first shape index $i_{shapeA}$ is obtained from the demultiplexing unit, or from an Arithmetic/range decoder;
      iii. the PVQ inverse enumeration module, e.g. an MPVQ-scheme decoder, converts the shape index $i_{shape,A}$ into a PVQ integer vector $rt_{linA}$ of length $N_a$ with L1-norm $K_a$.

TABLE 8

Multiplexing of Stage 1 indices and Stage 2 gain-shape information.

| ENCODER SEARCH SELECTED GAIN-SHAPE COMBINATION INDEX $I_{COMB}$ (NOT TRANSMITTED) | Stage1 Low (5 bits) | Stage 1 high (5 bits) | Stage 2 Submode index (0 = outlier, 1 = regular) (1 bit) | Stage 2 gain index | Stage 2 'PVQ' shape index | | Combination/shell description |
|---|---|---|---|---|---|---|---|
| 0-3 | $i_L$ | $i_H$ | 0 | $i_{gain}$ (2 bits) | $I_{shape,outl}$ (24.8536 fractional bits) | | Outlier shell |
| 4-5 | | | 1 | $i_{gain}$ (1 bit) | $I_{shapeA}$ (22.1886 fractional bits) | $I_{shapeB>0}$ (3.7004 fractional bits) | Regular shell both set {A, B} shapes |
| 6-7 | | | | | | $I_{shapeB=0}$ (3.7004 fractional bits) | Regular shell only set {A} shape |

iv. the second shape index $i_{shape,B}$ is obtained from the multiplexing unit, or from the Arithmetic/range decoder;

v. If $i_{shape,B}>0$, the PVQ inverse enumeration module, e.g. the MPVQ-scheme decoder, converts the second shape index $i_{shape,B}$-1 into a PVQ integer vector $rt_{linB}$ of length $N_b$ with L1-norm $K_b$;

vi. If $i_{shape,B}$ equals 0, $rt_{linB}$ is set to a vector of zeroes of length $N_b$;

vii. vectors $rt_{linA}$ and $rt_{linB}$ are re-sorted into the LSF-residual domain order as vector rt of length $(N_a+N_b)$.

4. The integer vector rt is normalized into a unit energy vector $LSF_{R2T,en1,dec}$ 5. The unit energy vector $LSF_{R2T,en1,dec}$ is warped back to the LSF residual domain by applying the IRDCT, the IDCT or the Hadamard on the unity energy vector, thereby receiving the LSF residual vector $LSF_{R2,en1,dec}$ Decoder Synthesis of the Final Quantized LSF-Vector $LSF_g$.

To obtain the quantized version of $LSF_{in}$, denoted $LSF_q$, at the decoder side, the following summation of the mean LSF and the stage 1 and stage 2 contribution is made.

$$LSF_q=[LSF_{Mean}]+[L_{iL}\ H_{iH}]+g_{hat}*GMEAN_{ST2}*[LSF_{R2,en1,dec}]$$

$LSF_q$ is now available in the decoder, for use by the overall decoding process, e.g. to represent the Direct-form AR-coefficients in 1/A(z) in a Linear Predictive time domain decoder or to represent a frequency envelope shape in a frequency domain decoder.

In the following, example tables for stage1 and stage 2 scaling operations and transforms in ANSI-C syntax are given.

Hadamard(16) Normalized Transform Coefficients

{0.250, 0.250, 0.250, 0.250, 0.250, 0.250, 0.250, 0.250, 0.250, 0.250, 0.250, 0.250, 0.250, 0.250, 0.250, 0.250, 0.250, −0.250, 0.250, −0.250, 0.250, −0.250, 0.250, −0.250, 0.250, −0.250, 0.250, −0.250, 0.250, −0.250, 0.250, −0.250, 0.250, 0.250, −0.250, −0.250, 0.250, 0.250, −0.250, −0.250, 0.250, 0.250, −0.250, −0.250, 0.250, 0.250, −0.250, −0.250, 0.250, −0.250, −0.250, 0.250, 0.250, −0.250, −0.250, 0.250, 0.250, −0.250, −0.250, 0.250, 0.250, 0.250, 0.250, 0.250, −0.250, −0.250, −0.250, −0.250, 0.250, 0.250, 0.250, 0.250, 0.250, −0.250, −0.250, −0.250, −0.250, 0.250, −0.250, 0.250, −0.250, −0.250, 0.250, −0.250, 0.250, 0.250, −0.250, 0.250, −0.250, −0.250, 0.250, −0.250, 0.250, 0.250, −0.250, 0.250, 0.250, −0.250, −0.250, −0.250, −0.250, 0.250, 0.250, 0.250, 0.250, −0.250, −0.250, −0.250, −0.250, 0.250, 0.250, 0.250, 0.250, 0.250, 0.250, 0.250, 0.250, −0.250, −0.250, −0.250, −0.250, −0.250, −0.250, −0.250, −0.250, 0.250, −0.250, 0.250, −0.250, 0.250, −0.250, 0.250, 0.250, −0.250, −0.250, 0.250, −0.250, 0.250, −0.250, 0.250, −0.250, 0.250, 0.250, 0.250, −0.250, −0.250, 0.250, 0.250, −0.250, −0.250, −0.250, −0.250, 0.250, 0.250, −0.250, −0.250, 0.250, 0.250, 0.250, −0.250, −0.250, 0.250, rdct_fwd_st2_fl, produces the first inverse transformed coefficient IRDCT(1) when applying the IRDCT transform as a matrix operation.

DCT(16) Normalized Transform Coefficients

In the table, DCT scaling factors are stored column wise, IDCT scaling factors are stored row wise.

{0.250, 0.352, 0.347, 0.338, 0.327, 0.312, 0.294, 0.273, 0.250, 0.224, 0.196, 0.167, 0.135, 0.103, 0.069, 0.035, 0.250, 0.338, 0.294, 0.224, 0.135, 0.035, −0.069, −0.167, −0.250, −0.312, −0.347, −0.352, −0.327, −0.273, −0.196, −0.103, 0.250, 0.312, 0.196, 0.035, −0.135, −0.273, −0.347, −0.338, −0.250, −0.103, 0.069, 0.224, 0.327, 0.352, 0.294, 0.167, 0.250, 0.273, 0.069, −0.167, −0.327, −0.338, −0.196, 0.035, 0.250, 0.352, 0.294, 0.103, −0.135, −0.312, −0.347, −0.224, 0.250, 0.224, −0.069, −0.312, −0.327, −0.103, 0.196, 0.352, 0.250, −0.035, −0.294, −0.338, −0.135, 0.167, 0.347, 0.273, 0.250, 0.167, −0.196, −0.352, −0.135, 0.224, 0.347, 0.103, −0.250, −0.338, −0.069, 0.273, 0.327, 0.035, −0.294, −0.312, 0.250, 0.103, −0.294, −0.273, 0.135, 0.352, 0.069, −0.312, −0.250, 0.167, 0.347, 0.035, −0.327, −0.224, 0.196, 0.338, 0.250, 0.035, −0.347, −0.103, 0.327, 0.167, −0.294, −0.224, 0.250, 0.273, −0.196, −0.312, 0.135, 0.338, −0.069, −0.352, 0.250, −0.035, −0.347, 0.103, 0.327, −0.167, −0.294, 0.224, 0.250, −0.273, −0.196, 0.312, 0.135, −0.338, −0.069, 0.352, 0.250, −0.103, −0.294, 0.273, 0.135, −0.352, 0.069, 0.312, −0.250, −0.167, 0.347, −0.035, −0.327, 0.224, 0.196, −0.338, 0.250, −0.167, −0.196, 0.352, −0.135, −0.224, 0.347, −0.103, −0.250, 0.338, −0.069, −0.273, 0.327, −0.035, −0.294, 0.312, 0.250, −0.224, −0.069, 0.312, −0.327, 0.103, 0.196, −0.352, 0.250, 0.035, −0.294, 0.338, −0.135, −0.167, 0.347, −0.273, 0.250, −0.273, 0.069, 0.167, −0.327, 0.338, −0.196, −0.035, 0.250, −0.352, 0.294, −0.103, −0.135, 0.312, −0.347, 0.224, 0.250, −0.312, 0.196, −0.035, −0.135, 0.273, −0.347, 0.338, −0.250, 0.103, 0.069, −0.224, 0.327, −0.352, 0.294, −0.167, 0.250, −0.338, 0.294, −0.224, 0.135, −0.035, −0.069, 0.167, −0.250, 0.312, −0.347, 0.352, −0.327, 0.273, −0.196, 0.103, 0.250, −0.352, 0.347, −0.338, 0.327, −0.312, 0.294, −0.273, 0.250, −0.224, 0.196, −0.167, 0.135, −0.103, 0.069, −0.035}

I.e. the values in the first column of dct_fwd_st2_fl, i.e. all values equal to 0.25=1/sqrt(16), produces the DC coefficient when applying the DCT transform as a matrix operation.

Further, the first row column of dct_fwd_st2_fl, produces the first inverse transformed coefficient IDCT(x) when applying the IDCT transform as a matrix operation.

$G_MEAN_{ST2}$ TABLE for various first stage base VQ-layer sizes 0 to 7 bits. $G_MEAN_{ST2}$ contains experimentally obtained values over a very large database for mean scaling of a $2^{nd}$ stage quantized residual vector, given a unit energy scaled PVQ-vector.

The gain-table may be produced by this function:

$MeanGain_st2=2^{(x^*-0.111645+-3.431255)}$, which is using a log 2 linear relation for the mean gain and first stage base bits x, with x bits for each split.

float MeanGain_st2_fl[8]={0.0927047729f, 0.0794105530f, 0.0680236816f, 0.0582695007f, 0.0499153137f, 0.0427551270f, 0.0366249084f, 0.0313720703f};

I.e. $G_MEAN_{ST2}$ when using a 2×5 bit first stage LSF-VQ is MeanGain_s2_fl[5]=0.0427551270f.

LSFmean Table

The $LSF_{mean}$ table may be trained off-line or simply use a linear spread of points over the normalized frequency unit circle range [0 . . . 1.0], where 1.0 corresponds to Fs/2, i.e. half the sampling frequency. An example of an $LSF_{mean}$ table:

{0.0604248047f, 0.1060791016f, 0.1582641602f, 0.2119750977f, 0.2736206055f, 0.3338623047f, 0.3935546875f, 0.4495849609f, 0.5078125000f, 0.5642089844f, 0.6213378906f, 0.6777343750f, 0.7379150391f, 0.7984619141f, 0.8619995117f, 0.9247436523f}

Example of First Stage 8 Dimensional Codebooks {L, H} Using 5 Bits Each

LSF-residual codebooks L and H are typically trained offline on a large data set.

{−0.013, −0.018, −0.018, −0.012, 0.009, 0.029, 0.043, 0.046, −0.008, −0.012, −0.015, −0.018, −0.022, −0.028, −0.031, −0.032, −0.023, −0.036, −0.050, −0.060, −0.062, −0.041, −0.014, 0.001, 0.020, 0.024, 0.026, 0.018, −0.003, −0.023, −0.041, −0.049, 0.048, 0.091, 0.102, 0.099, 0.079, 0.063, 0.051, 0.042, −0.003, 0.001, 0.013, 0.016, 0.007, −0.005, −0.016, −0.023, −0.009, −0.004, 0.014, 0.046, 0.074, 0.085, 0.092, 0.093, −0.021, −0.031, −0.044, −0.056, −0.070, −0.073, −0.069, −0.055, 0.009, 0.007, 0.001, −0.009, −0.020, −0.020, −0.004, −0.001, −0.018, −0.027, −0.036, −0.040, −0.041, −0.037, −0.029, −0.020, −0.016, −0.017, −0.009, 0.009, 0.039, 0.056, 0.066, 0.070, −0.014, −0.019, −0.020, −0.013, 0.003, 0.013, 0.014, 0.015, 0.005, 0.016, 0.026, 0.032, 0.031, 0.031, 0.031, 0.031, 0.062, 0.073, 0.068, 0.065, 0.058, 0.047, 0.039, 0.036, −0.010, −0.014, −0.014, −0.011, −0.008, −0.007, −0.008, −0.008, 0.049, 0.050, 0.043, 0.050, 0.040, 0.029, 0.060, 0.060, −0.015, −0.023, −0.033, −0.036, −0.024, 0.004, 0.031, 0.038, 0.002, 0.004, 0.005, 0.003, 0.004, 0.003, 0.004, 0.003, 0.032, 0.039, 0.045, 0.045, 0.043, 0.032, 0.022, 0.014, 0.004, 0.003, −0.004, −0.015, −0.030, −0.042, −0.055, −0.059, 0.024, 0.028, 0.027, 0.024, 0.021, 0.016, 0.011, 0.007, 0.052, 0.067, 0.061, 0.049, 0.028, 0.012, −0.001, −0.010, 0.026, 0.029, 0.027, 0.019, 0.008, −0.003, −0.010, −0.016, 0.018, 0.036, 0.055, 0.081, 0.095, 0.098, 0.098, 0.096, 0.019, 0.027, 0.031, 0.038, 0.048, 0.052, 0.053, 0.055, 0.011, 0.010, 0.004, −0.005, −0.015, −0.020, −0.027, −0.032, −0.008, −0.004, 0.010, 0.023, 0.036, 0.042, 0.045, 0.046, −0.007, −0.004, 0.005, 0.014, 0.016, 0.014, 0.017, 0.020, 0.012, 0.027, 0.045, 0.064, 0.072, 0.075, 0.067, 0.058, 0.000, 0.028, 0.060, 0.094, 0.080, 0.053, 0.023, −0.001, −0.008, −0.015, −0.024, −0.034, −0.046, −0.057, −0.064, −0.060, −0.018, −0.026, −0.035, −0.038, −0.030, −0.011, 0.000, 0.005};

i.e. index $i_L$=0 in codebook L yields vector:

{−0.013, −0.018, −0.018, −0.012, 0.009, 0.029, 0.043, 0.046} and index $i_L$=31 in codebook L yields vector:

{−0.018, −0.026, −0.035, −0.038, −0.030, −0.011, 0.000, 0.005}; {−0.066, −0.069, −0.071, −0.061, −0.035, −0.013, −0.002, 0.003, 0.026, 0.037, 0.048, 0.061, 0.063, 0.055, 0.041, 0.025, −0.083, −0.080, −0.057, −0.026, −0.002, 0.006, 0.009, 0.009, −0.037, −0.041, −0.046, −0.049, −0.036, −0.014, −0.008, −0.002, −0.002, −0.006, −0.017, −0.029, −0.046, −0.049, −0.010, 0.001, 0.029, 0.024, 0.017, 0.009, −0.003, −0.015, −0.022, −0.020, 0.057, 0.074, 0.093, 0.104, 0.091, 0.073, 0.050, 0.028, −0.002, 0.006, 0.018, 0.026, 0.032, 0.030, 0.023, 0.015, 0.024, 0.030, 0.035, 0.038, 0.036, 0.031, 0.023, 0.015, −0.054, −0.049, −0.040, −0.030, −0.022, −0.019, −0.011, −0.003, −0.038, −0.042, −0.045, −0.048, −0.050, −0.048, −0.042, −0.020, −0.029, −0.030, −0.038, −0.046, −0.059, −0.055, −0.005, 0.004, 0.024, 0.021, 0.018, 0.017, 0.014, 0.011, 0.008, 0.004, 0.001, 0.003, 0.005, 0.006, 0.008, 0.008, 0.007, 0.004, 0.113, 0.118, 0.111, 0.101, 0.082, 0.064, 0.044, 0.024, 0.066, 0.035, 0.000, −0.025, −0.024, 0.005, 0.010, 0.009, 0.060, 0.057, 0.050, 0.043, 0.030, 0.019, 0.009, 0.002, 0.038, 0.037, 0.034, 0.028, 0.019, 0.011, 0.005, 0.001, 0.109, 0.096, 0.058, 0.018, −0.015, −0.030, 0.003, 0.009, −0.032, −0.023, −0.008, 0.006, 0.017, 0.017, 0.014, 0.010, −0.022, −0.027, −0.031, −0.035, −0.032, −0.030, −0.029, −0.020, 0.095, 0.093, 0.085, 0.076, 0.060, 0.046, 0.030, 0.015, −0.001, −0.008, −0.016, −0.018, −0.006, 0.010, 0.012, 0.009, 0.012, 0.010, 0.003, −0.004, −0.010, −0.013, −0.006, −0.002, −0.025, −0.019, −0.011, −0.005, −0.003, −0.007, −0.008, −0.007, −0.013, −0.019, −0.030, −0.043, −0.050, −0.012, −0.004, −0.005, −0.035, −0.036, −0.034, −0.022, −0.004, 0.004, 0.006, 0.005, −0.018, −0.021, −0.027, −0.034, −0.049, −0.061, −0.066, −0.037, −0.052, −0.057, −0.063, −0.067, −0.067, −0.045, −0.024, −0.007, 0.003, −0.001, −0.007, −0.013, −0.023, −0.031, −0.036, −0.026, −0.011, −0.013, −0.017, −0.021, −0.020, −0.019, −0.016, −0.010, 0.061, 0.066, 0.066, 0.062, 0.052, 0.042, 0.030, 0.017};

i.e. index $i_H$=0 in codebook H yields vector:

{−0.066, −0.069, −0.071, −0.061, −0.035, −0.013, −0.002, 0.003};

and index $i_H$=31 in codebook H yields vector:

{0.061, 0.066, 0.066, 0.062, 0.052, 0.042, 0.030, 0.017};

In the following, Spectral distortion (with and without transforms) for Outlier mode, Regular mode, Combined mode will be discussed.

Figure 9:
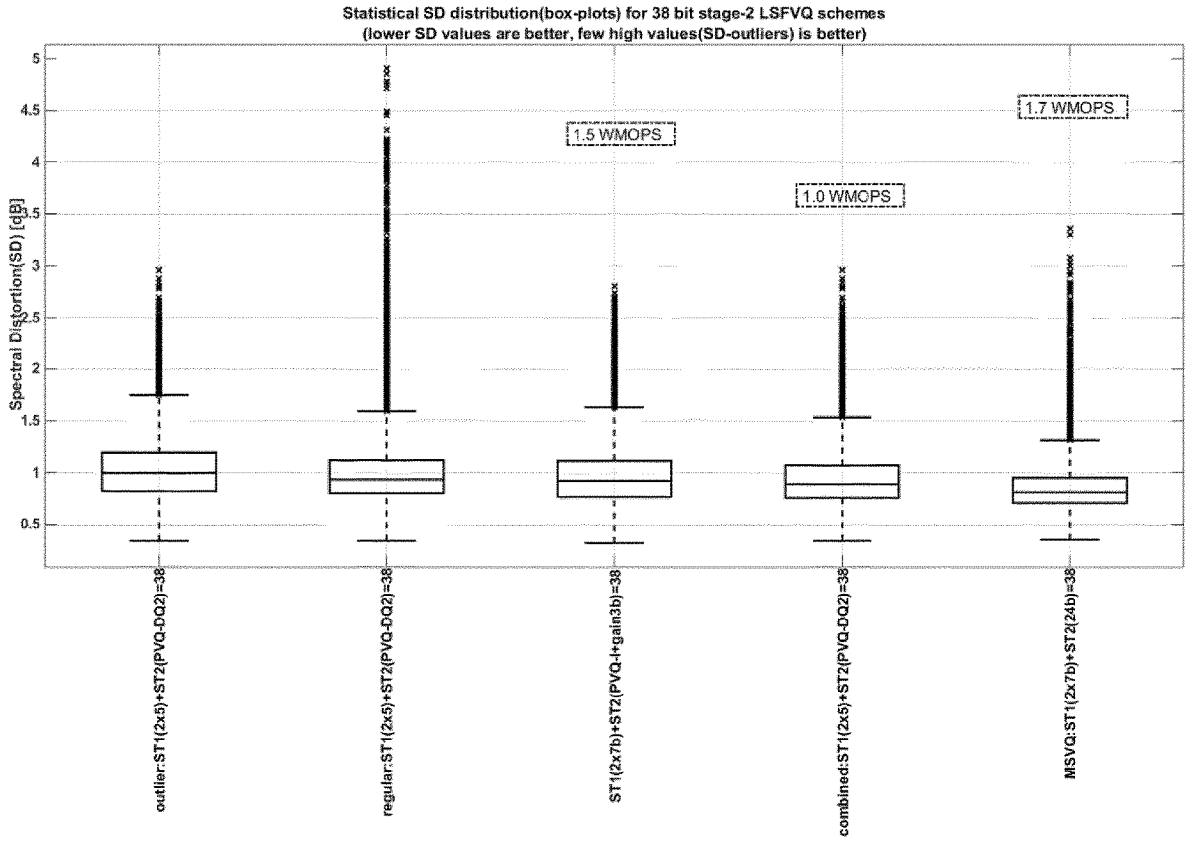
FIG. 9 shows example results for 38 bit LSF quantizers, using the DCT as transform.

In FIG. 9, a box plot with the SD (Spectral Distortion) results for a 38 bit VQ realization are shown. A box plot shows the statistical distribution of a signal. In each box, the central mark is the median SD, the edges of the box are the 25th and 75th percentiles, the whiskers (lines) extend to the most extreme data points not considered outliers, and outliers are plotted individually as x's. SD is a standard measure within speech and audio coding showing how close the logarithmic FFT (Fast Fourier Transform) envelope of the quantized LSFs (denoted $LSF_q$) is to the logarithmic FFT envelope of the un-quantized LSFs ($LSF_{in}$). Typically one would like to achieve as low median value as possible, a quite condensed percentile box-area, and as few outliers as possible.

From left to right is shown:

1. Locked to outlier mode SD-performance, with 2×5b stage1 quantization
2. Locked to regular mode SD-performance, with 2×5b stage1 quantization
3. Extended gain-shape mode SD-performance, with 2×7b stage1 quantization, 3 bits gain
4. The combined outlier and regular mode SD-performance, with 2×5b stage 1 quantization
5. A dual stage trained Multistage Split Vector Quantizer, MS-SVQ, realization, SD-performance, with 2×7b stage1 quantization, and 24 bit stage 2 quantization. Where stage 2 is a Split-VQ to maintain reasonable complexity.

Weighted Million Operations per Second, WMOPS, figures are given for (3,4,5) in the list above. It can be seen that the 1.0 WMOPS combined mode(4) performs nearly as well as the 1.7 WMOPS MS-SVQ(5) and with fewer outlier points, and further it can be seen that the combined mode performs at least as well as a mode with a larger first stage(3), using 50% higher total complexity.

Table 9 shows complexity estimation for an LSF update rate of 100 Hz (every 10 ms),

TABLE 9

| Complexity estimation | |
|---|---|
| Module | WC-WMOPS |
| Legacy 2 × 8 bit 1$^{st}$ stage search | 2 * $2^8$ * 23cycles * 100 Hz = 1.2 WMOPS |
| Legacy 2 × 7 bit 1$^{st}$ stage search | 2 * $2^7$ * 23cycles * 100 Hz = 0.6 WMOPS |
| Proposed 2 × 5 bit 1$^{st}$ stage search | 2 * $2^5$ * 23cycles * 100 Hz = 0.15 WMOPS |
| RDCT/DCT transform(N = 16)<br>IRDCT/IDCT transform (N = 16) | 16 * 3 + 16 * (16 + 2) cycles * 100 Hz = 0.03 WMOPS |
| Hadamard Transform(N = 16) | 16 * 3 + 16 * (log2(16) + 4) cycles * 100 Hz = 0.01 WMOPS |

Figure 10:
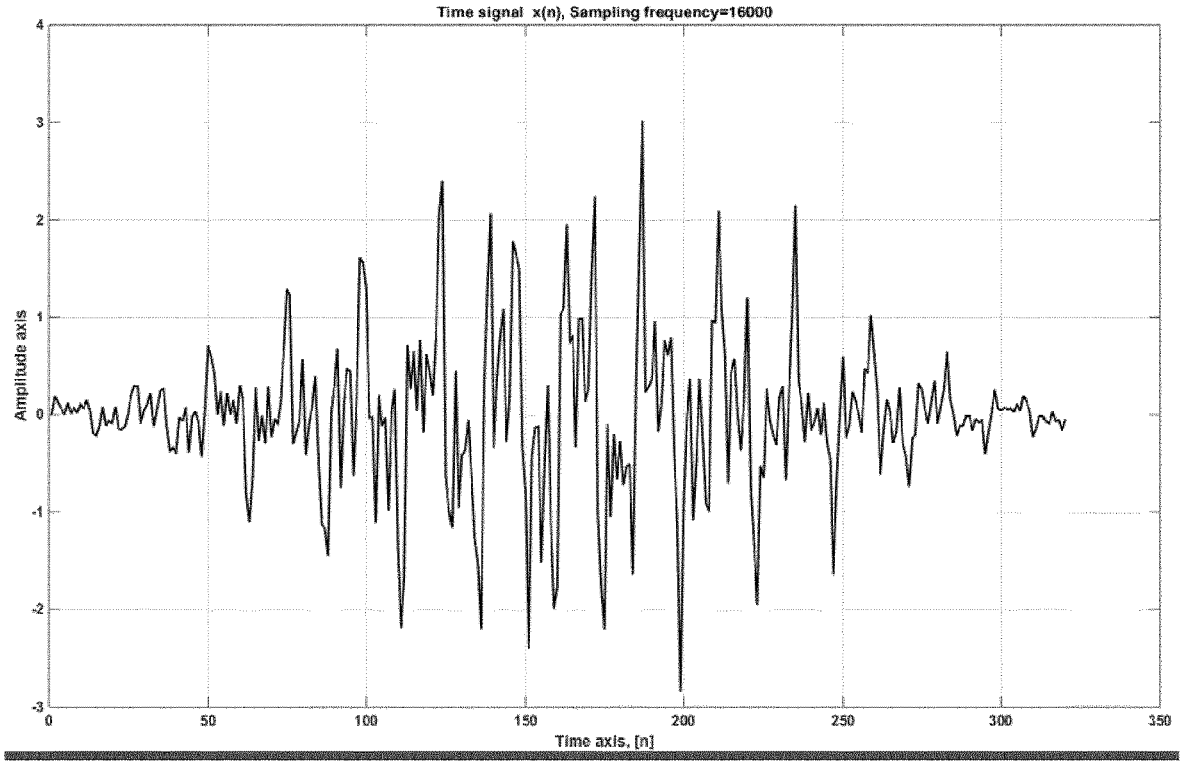
FIG. 10 shows an example of a time domain signal.

FIG. 10 depicts an example of a time domain signal, for which a frequency envelope is to be quantized by the proposed LSF quantizer. The example shown is 20 ms of a 16 kHz sampled signal.

Figure 11:
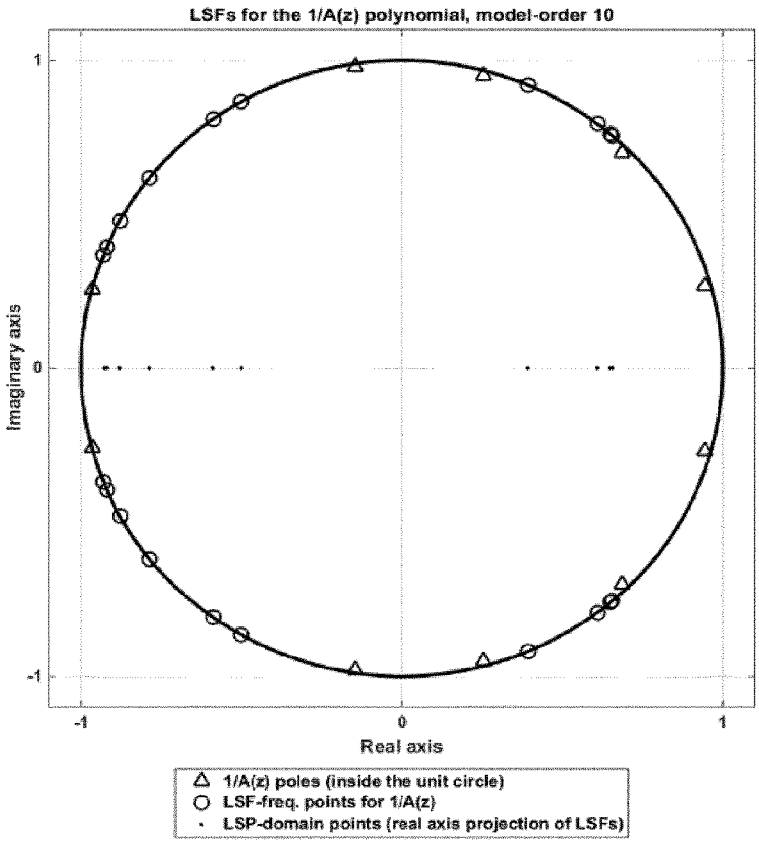
FIG. 11 shows 1/A(z) poles and LSF/LSP frequency points for the time signal.

FIG. 11 shows 1/A(z) poles and LSF/LSP frequency points for the time signal in FIG. 10. FIG. 11 depicts the position of the roots of 1/(Az), where A(z) is the result of a 10th order Linear Prediction analysis of the time signal in FIG. 10. The corresponding 10 LSFs that are to be transmitted are positioned on the top half of the unit circle as angles in the radian range 0 to pi, but typically one will use the linearly related frequency notation, where 0 radians corresponds to 0 Hz and pi radians corresponds to Fs/2, where Fs is the sampling frequency for the corresponding time signal.

Figure 12:
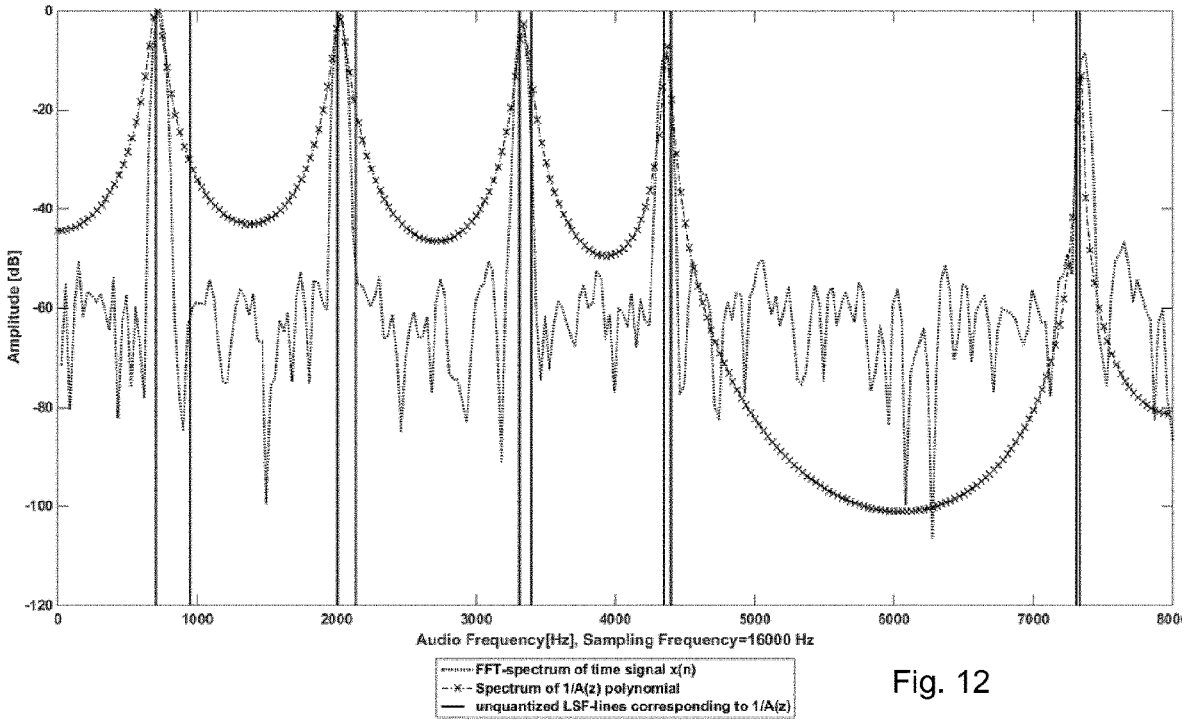
FIG. 12 shows FFT spectrum of the time signal.

FIG. 12 shows FFT spectrum of the time signal, the spectral envelope achieved by representing the signal with the 1/A(z) polynomial and the un-quantized LSF lines corresponding to 1/A(z). FIG. 12 depicts the spectral positions (along the frequency axis) of the LSFs corresponding to 1/(Az), where A(z) is the result of a 10th order Linear Prediction analysis of the Time signal in FIG. 10. For a signal with rather clear spectral peaks one may find that the 10 LSF coefficients that are to be quantized and transmitted to represent the spectral envelope, are located close to the spectral peaks of the signal, and further they appear in pairs close to each other. This peak/LSF-coefficient relationship for harmonic signal is often used to determine the LSF-quantizer weights in a speech/audio encoder as the spectral peaks have been found subjectively more important than spectral valleys.

Figure 13:
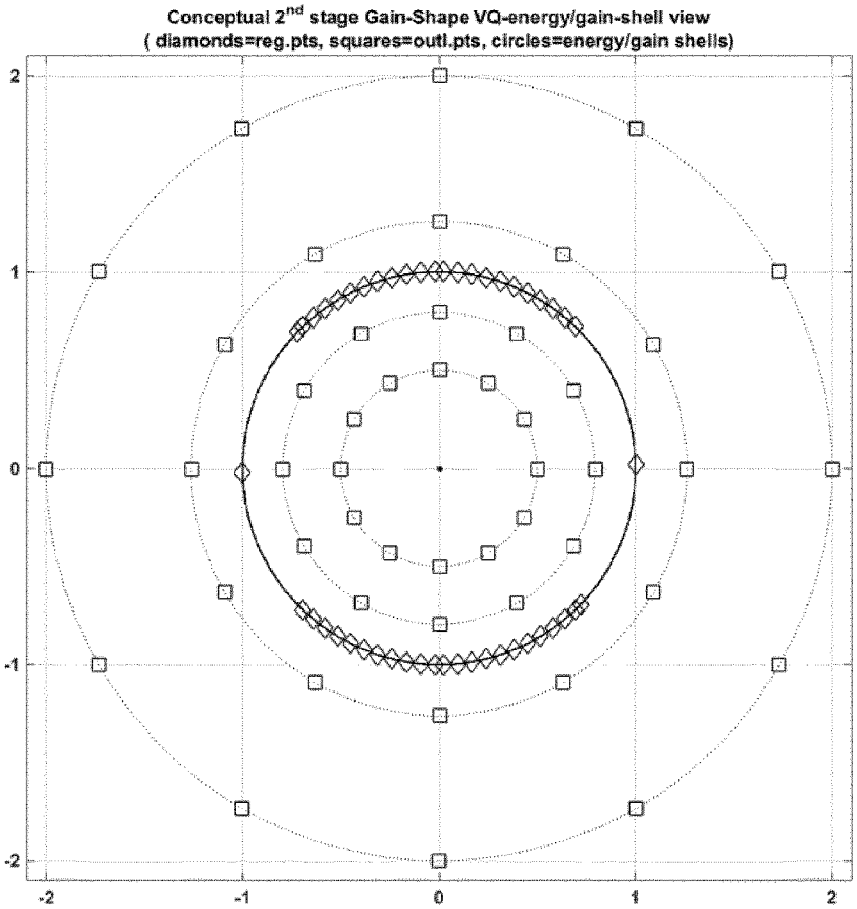
FIG. 13 shows a conceptual 2-D projected view of the proposed LSF-quantizer.

FIG. 13 depicts a conceptual 2-D projected view of the shells and submodes of the proposed gain-shape LSF-quantizer, (It is conceptual as the locations of the various reconstruction points are not true Pyramid VQ points). In the figure there are several gain/energy shells available, with one regular "center" shell (solid circle) that has more reconstruction points (diamonds) in the composite dimension direction given by a set A, than in another composite dimension direction given by set B. Further there are several outlier shells (dotted circles) which have energies which differ from the regular shell. Each outlier shell has a reduced number of construction points in comparison to the regular "center" shell, and further each outlier shell does not have any dimensional set restriction to be able to handle all types of LSF-residual signals, in both gain and shape directions (i.e. the outlier set handles all dimensions equally and each energy shell has the same number of code points).

To maintain a low complexity, the search is first performed in the shape-only direction assuming optimal gain with the outlier submode resolution, and when that resolution has been achieved, the shape resolution is extended in the regular resolution set{A} dimensions, and possibly reduced in the regular resolution set{B} dimensions. In a second search step the total gain-shape error is evaluated for all the available energy shells.

Figure 14:
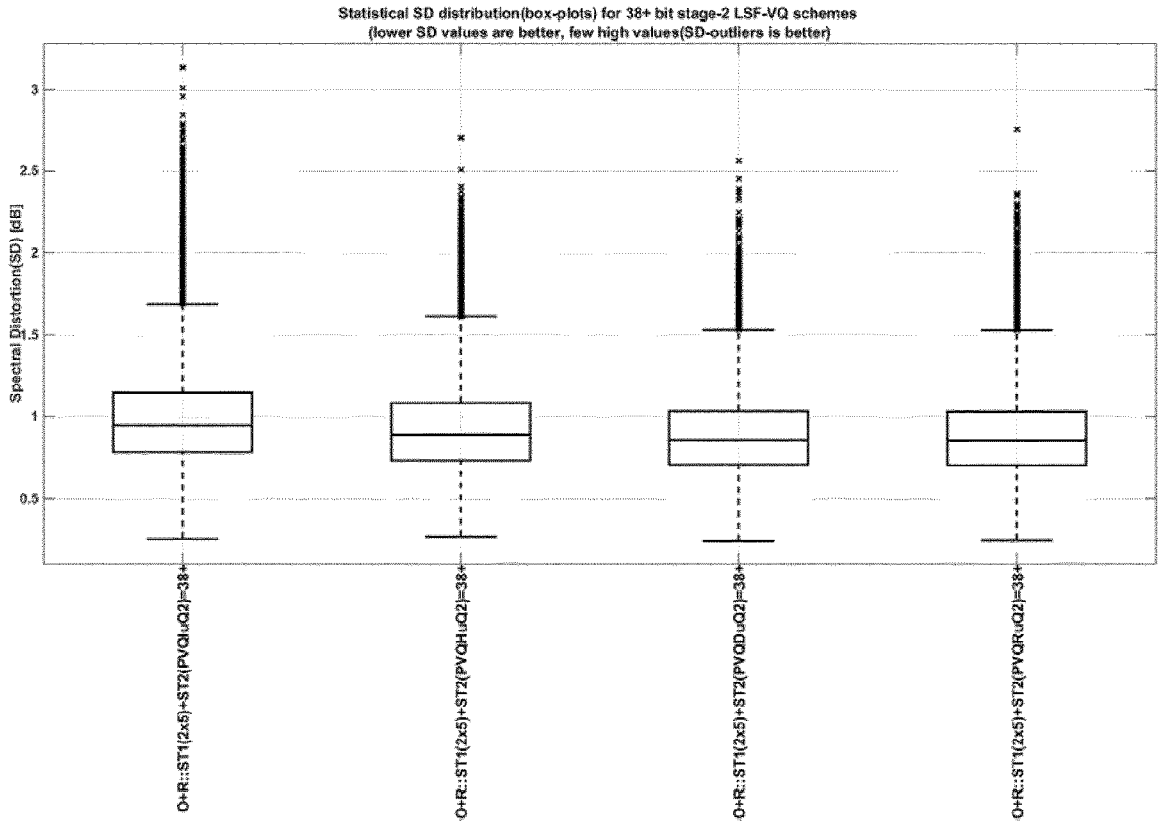
FIG. 14 shows an example of statistical spectral distortion distribution.

FIG. 14 shows SD-performance in terms of a boxplot for the combined outlier plus regular shells for various warping schemes. The boxes are presented in decreasing median order as follows: Identity(=no transformation), H=Hadamard, D=DCT, R=Rotated(ACF)-DCT), in the figure the gain quantization for the 38 bit scheme has been turned off to not add noise to the comparison of the various warping schemes.

In FIG. 14 one can identify that there is a clear advantage to warp the LSF-input signal, as the Identity transform (no warping) performs considerably worse than the other schemes, further one can find that the Hadamard performs worse than the DCT and RDCT schemes, and further the RDCT warping has slightly better median SD-performance than the DCT, and a similar SD-outlier distribution.

Figure 15:
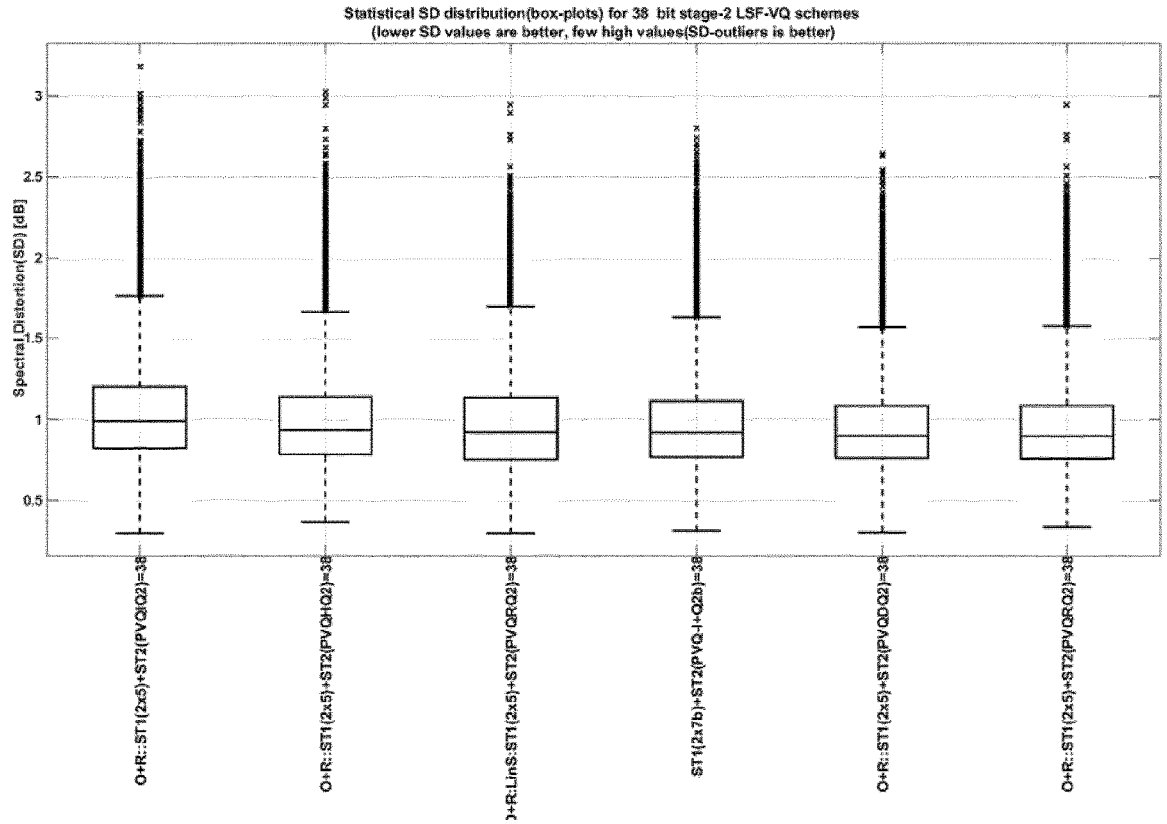
FIG. 15 shows another example of statistical spectral distortion distribution.

FIG. 15 shows SD-performance in terms of a boxplot for the combined outlier plus regular shells for various fully quantized 38 bit warping schemes. The boxes are presented in decreasing median order as follows: 2×5 bits stage 1 and Identity(=no transformation); 2×5 bits stage 1 and H=Hadamard; 2×5 bits stage 1 and RDCT with the linear search option); 2×7 bits stage 1 and Identity(=no transformation); 2×5 bits stage 1 and DCT; 2×5 bits stage 1 and RDCT.

In FIG. 15 one can identify that there is a small cost associated with using the average complexity optimized linear search (an increase SD-spread is seen for third box with linear RDCT search), further one can find that with the gain quantization active the Hadamard warping scheme is now approaching the performance of the other warping scheme in terms of SD performance (in relation to the un-quantized gain results in FIG. 14).

In accordance with the above, an efficient low complexity method is provided for quantization of LSF coefficients.

According to embodiments, application of a Transform to the LSF-residual enables a very low rate and low complex first stage in the VQ without sacrificing performance.

According to embodiments, selection of an outlier submode in a multimode PVQ quantizer enables efficient handling of LSF-residual outliers. Outliers have very high or very low energy/gains or an atypical shape.

According to embodiments, selection of a regular submode in a multimode PVQ quantizer enables higher resolution coding of the most frequent/typical LSF-residual shapes.

According to embodiments, for enabling an efficient PVQ-search scheme, the outlier mode employs a non-split VQ while the regular non-outlier submode employs a split-VQ, with different bits/coefficient in each split segment. Further the split segments may preferably be a nonlinear sample of the transformed vector.

According to embodiments, application of an efficient dual(multi)-mode PVQ-search enables a very efficient search and sub-mode selection in a multimode PVQ-based gain-shape structure.

Figure 16:
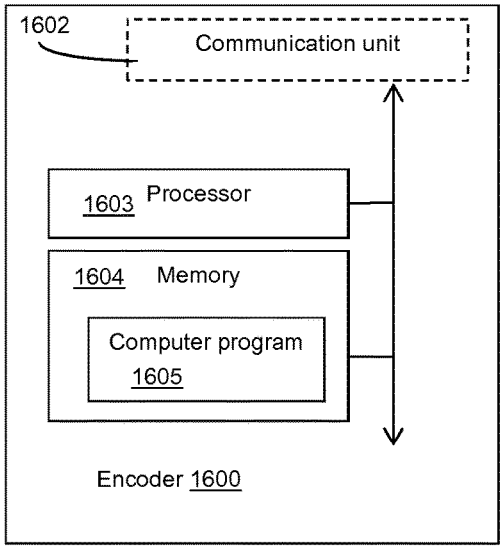
FIG. 16 shows a block diagram illustrating an example embodiment of an encoder.
Figure 17:
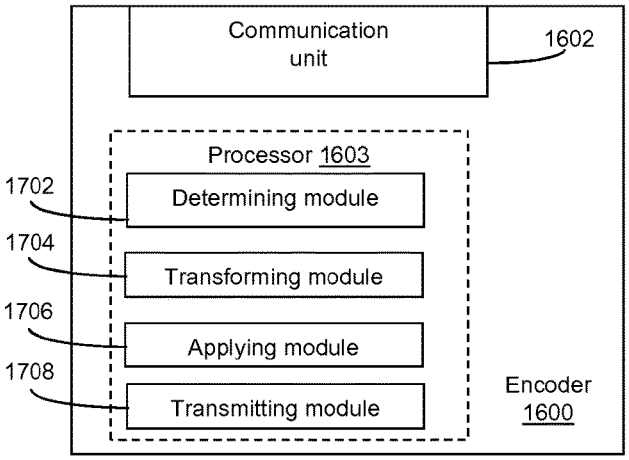
FIG. 17 shows a block diagram illustrating another example embodiment of an encoder.
Figure 18:
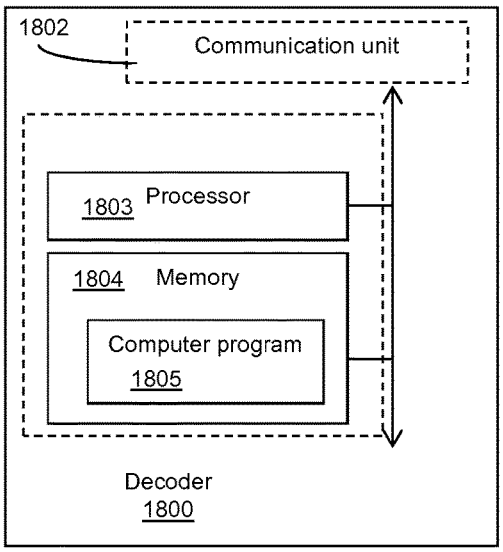
FIG. 18 shows a block diagram illustrating an example embodiment of a decoder.
Figure 19:
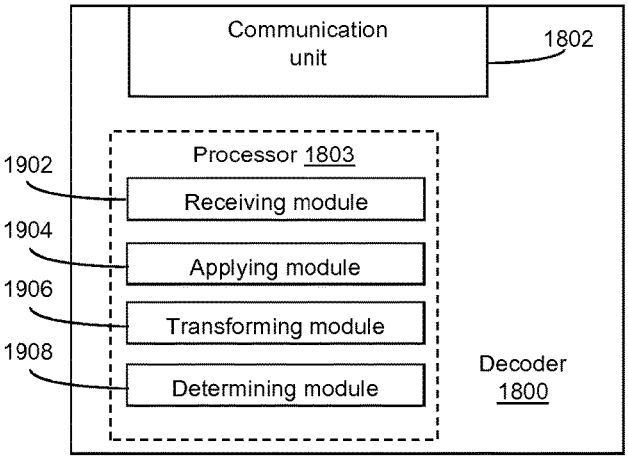
FIG. 19 shows a block diagram illustrating another example embodiment of a decoder.

To perform the methods and actions herein, an encoder 1600 and a decoder 1800 are provided. FIGS. 16-17 are block diagrams depicting the encoder 1600. FIGS. 18-19 are block diagrams depicting the decoder 1800. The encoder 1600 is configured to perform the methods described for the encoder 1600 in the embodiments described herein, while the decoder 1800 is configured to perform the methods described for the decoder 1800 in the embodiments described herein.

For the encoder, the embodiments may be implemented through one or more processors 1603 in the encoder depicted in FIGS. 16 and 17, together with computer program code 1605 for performing the functions and/or method actions of the embodiments herein. The program code mentioned above may also be provided as a computer program product, for instance in the form of a data carrier carrying computer program code for performing embodiments herein when being loaded into the encoder 1600. One such carrier may be in the form of a CD ROM disc. It is however feasible with other data carriers such as a memory stick. The computer program code may furthermore be provided as pure program code on a server and downloaded to the encoder 1600. The encoder 1600 may further comprise a communication unit 1602 for wireline or wireless communication with e.g. the decoder 1800. The communication unit may be a wireline or wireless receiver and transmitter or a wireline or wireless transceiver. The encoder 1600 further comprises a memory 1604. The memory 1604 may, for example, be used to store applications or programs to perform the methods herein and/or any information used by such applications or programs. The computer program code may be downloaded in the memory 1604.

An audio encoder 1600 may comprise an apparatus for handling input Line Spectral Frequency, LSF, coefficients ($LSF_{in}$), wherein the apparatus is configured to determine LSF residual coefficients ($LSF_{R2}$) as first compressed LSF coefficients subtracted from the input LSF coefficients, and to transform the LSF residual coefficients ($LSF_{R2}$) into a warped domain ($LSF_{R2T}$); to apply one of a plurality of gain-shape coding schemes on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients; and transmit, over a communication channel to a decoder, the first compressed LSF coefficients, the gain-shape coded LSF residual coefficients, and information on the applied gain-shape coding scheme.

The apparatus my further be configured to quantize the input LSF coefficients using a first number of bits and determine LSF residual coefficients ($LSF_{R2}$) by subtracting the quantized LSF coefficients from the input LSF coefficients, wherein the transmitted first compressed LSF coefficients are the quantized LSF coefficients. The apparatus my further be configured to selectively apply one of the plurality of gain-shape coding schemes on the transformed LSF residual coefficients. The apparatus my further be configured to remove a mean from the input LSF coefficients. The apparatus my further be configured to transform the first compressed LSF coefficients into a warped domain.

The encoder 1600 may according to the embodiment of FIG. 17 comprise a determining module 1702 for determining LSF residual coefficients as first compressed LSF coefficients subtracted from the input LSF coefficients, and a transforming module 1704 for transforming the LSF residual coefficients into a warped domain. The encoder 1600 may further comprise an applying module for 1706 for applying one of a plurality of gain-shape coding schemes on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients, and a transmitting module 1708 for transmitting, over a communication channel to a decoder, the first compressed LSF coefficients, the gain-shape coded LSF residual coefficients, and information on the applied gain-shape coding scheme.

For the decoder 1800, the embodiments herein may be implemented through one or more processors 1803 in the decoder 1800 depicted in FIGS. 18 and 19, together with computer program code 1805 for performing the functions and/or method actions of the embodiments herein. The program code mentioned above may also be provided as a computer program product, for instance in the form of a data carrier carrying computer program code for performing embodiments herein when being loaded into the decoder 1800. One such carrier may be in the form of a CD ROM disc. It is however feasible with other data carriers such as a memory stick. The computer program code may furthermore be provided as pure program code on a server and downloaded to the decoder 1800. The decoder 1800 may further comprise a communication unit 1802 for wireline or wireless communication with the e.g. the encoder 1600. The communication unit may be a wireline or wireless receiver and transmitter or a transceiver. The decoder 1800 further comprises a memory 1804. The memory 1804 may, for example, be used to store applications or programs to perform the methods herein and/or any information used by such applications or programs. The computer program code may be downloaded in the memory 1804.

An audio decoder 1800 may comprise an apparatus for handling input Line Spectral Frequency, LSF, coefficients ($LSF_{in}$), wherein the apparatus is configured to receive, over a communication channel from an encoder (1600), a representation of first compressed LSF coefficients, gain-shape coded LSF residual coefficients, and information on an applied gain-shape coding scheme, applied by the encoder; to apply, one of a plurality of gain-shape decoding schemes on the received gain-shape coded LSF residual coefficients according to the received information on applied gain-shape coding scheme, in order to achieve LSF residual coefficients, where the plurality of gain-shape decoding schemes have mutually different trade-offs in one or more of gain resolution and shape resolution for one or more of the gain-shape coded LSF residual coefficients; to transform the LSF residual coefficients from a warped domain into an LSF original domain, and to determine LSF coefficients as the transformed LSF residual coefficients added with the received first compressed LSF coefficients.

The apparatus may further be configured to de-quantize the quantized LSF coefficients using a first number of bits corresponding to the number of bits used for quantizing LSF coefficients at a quantizer of the encoder, and to determine the LSF coefficients as the transformed LSF residual coefficients added with the de-quantized LSF coefficients, wherein the received first compressed LSF coefficients are quantized LSF coefficients. The apparatus may further be configured to receive, over the communication channel from the encoder, the first number of bits used at a quantizer of the encoder.

The decoder 1800 may according to the embodiment of FIG. 19 comprise a receiving module 1902 for receiving, over a communication channel from an encoder, first compressed LSF coefficients, gain-shape coded LSF residual coefficients, and information on an applied gain-shape coding scheme, applied by the encoder. The decoder may further comprise an applying module 1904 for applying one of a plurality of gain-shape decoding schemes on the received gain-shape coded LSF residual coefficients according to the received information on applied gain-shape coding scheme, in order to achieve LSF residual coefficients, where the plurality of gain-shape decoding schemes have mutually different trade-offs in one or more of gain resolution and shape resolution for one or more of the gain-shape coded LSF residual coefficients. The decoder may further comprise a transforming module 1906 for transforming the LSF residual coefficients from a warped domain into an LSF original domain, and a determining module 1908 for determining LSF coefficients as the transformed LSF residual coefficients added with the received first compressed LSF coefficients.

As will be readily understood by those familiar with communications design, functions from other circuits may be implemented using digital logic and/or one or more microcontrollers, microprocessors, or other digital hardware. In some embodiments, several or all of the various functions may be implemented together, such as in a single application-specific integrated circuit (ASIC), or in two or more separate devices with appropriate hardware and/or software interfaces between them.

From the above it may be seen that the embodiments may further comprise a computer program product, comprising instructions which, when executed on at least one processor, e.g. the processors 1603 or 1803, cause the at least one processor to carry out any of the methods described. Also, some embodiments may, as described above, further comprise a carrier containing said computer program, wherein the carrier is one of an electronic signal, optical signal, radio signal, or computer readable storage medium.

Although the description above contains a plurality of specificities, these should not be construed as limiting the scope of the concept described herein but as merely providing illustrations of some exemplifying embodiments of the described concept. It will be appreciated that the scope of the presently described concept fully encompasses other embodiments which may become obvious to those skilled in the art, and that the scope of the presently described concept is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein by reference and are intended to be encompassed hereby. Moreover, it is not necessary for an apparatus or method to address each and every problem sought to be solved by the presently described concept, for it to be encompassed hereby. In the exemplary figures, a broken line generally signifies that the feature within the broken line is optional.

Example Embodiments

1. A method performed by an encoder (1600) of a communication system (100) for handling input Line Spectral Frequency, LSF, coefficients ($LSF_{in}$), the method comprising:

determining (204) LSF residual coefficients ($LSF_{R2}$) as first compressed LSF coefficients subtracted from the input LSF coefficients;

transforming (206) the LSF residual coefficients ($LSF_{R2}$) into a warped domain ($LSF_{R2T}$), applying (208), one of a plurality of gain-shape coding schemes on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients; and transmitting (210), over a communication channel to a decoder, the first compressed LSF coefficients, the gain-shape coded LSF residual coefficients, and information on the applied gain-shape coding scheme.

The steps of handling the LSF residual coefficients has an advantage in that it provides a computationally efficient handling that at the same time results in an efficient compression of the LSF residual. Consequently, the method results in a computation efficient and compression efficient handling of the LSF coefficients.

The LSF coefficients may also be called an LSF coefficient vector. Similarly, the LSF residual coefficients may be called an LSF residual coefficient vector. The warped domain may be a warped quantization domain. The application of one of the plurality of gain-shape coding schemes may be performed per LSF residual coefficient basis. For example, a first scheme may be applied for a first group of LSF residual coefficients and a second scheme may be applied for a second group of LSF residual coefficients.

The wording "resolution" above signifies number of bits used for a coefficient. In other words, gain resolution signifies number of bits used for defining gain for a coefficient and shape resolution signifies number of bits used for defining shape for a coefficient.

2. Method according to embodiment 1, further comprising: quantizing (202) the input LSF coefficients using a first number of bits, and wherein the determining (204) of LSF residual coefficients ($LSF_{R2}$) comprises subtracting the quantized LSF coefficients from the input LSF coefficients, and the transmitted (210) first compressed LSF coefficients are the quantized LSF coefficients.

The above method has the advantage that it enables a low first number of bits used in the quantizing step.

3. Method according to any of the preceding embodiments, wherein the applying (208) of one of a plurality of gain-shape coding schemes on the transformed LSF residual coefficients comprises selectively applying the one of the plurality of gain-shape coding schemes.

By selectively applying a gain-shape coding scheme the encoder can select the gain-shape coding scheme that is best suited for the individual coefficient.

4. Method according to embodiment 3, wherein the selection in the selectively applying (208) of the one of the plurality of gain-shape coding schemes is performed by a combination of a PVQ shape projection and a shape fine search to reach a first PVQ pyramid code point over available dimensions on a per LSF residual coefficient basis.

The above embodiment has the advantage that it lowers average computational complexity.

5. Method according to embodiment 3, wherein the selection in the selectively applying (208) of the one of the plurality of gain-shape coding schemes is performed by a combination of a PVQ shape projection and a shape fine search to reach a first PVQ pyramid codepoint over available dimensions followed by another shape fine search to reach a second PVQ pyramid code point within a restricted set of dimensions.

6. Method according to any of the preceding embodiments, wherein the plurality of gain-shape coding schemes comprises a PVQ regular coding scheme having a first approximately constant coefficient gain at 1.0 and a PVQ outlier coding scheme having a second coefficient gain that is selectable between a first and a second value.

In other words, in PVQ regular coding scheme, as the coefficient gain here is said to be approximately constant at 1.0, bits can be used only, or at least mainly, for defining shape. In PVQ outlier mode, on the other hand, bits are used both for defining gain and shape. As an example, the first value of the second gain coefficient may be 0.5 and the second value of the second gain coefficient may be 2,0. The PVQ regular coding scheme may be called PVQ regular mode, or sub-mode. Similarly, the PVQ outlier coding scheme may be called PVQ outlier mode, or sub-mode. The coefficient gain above is a linear adjustment gain of a given long term mean gain ($G_MEAN_{ST2}$) for the gain-shape stage. (If one would define the adjustment gain in a logarithmic domain, the value "1.0" in the linear domain above, would correspond to 0 dB.)

7. Method according to any of the preceding embodiments, wherein the plurality of gain-shape coding schemes use mutually different bit resolutions for different subsets of LSF residual coefficients.

8. Method according to any of the preceding embodiments, wherein the input LSF coefficients are DC component removed LSF coefficients.

9. Method according to any of the preceding embodiments, further comprising: transforming the first compressed LSF coefficients into a warped domain.

According to another embodiment, an encoder is provided that is configured to perform any of the mentioned embodiments above.

10. A method performed by a decoder (1800) of a communication system (100) for handling Line Spectral Frequency, LSF, coefficients, the method comprising:

receiving (302), over a communication channel from an encoder (1600), first compressed LSF coefficients, gain-shape coded LSF residual coefficients, and information on an applied gain-shape coding scheme, applied by the encoder;

applying (304), one of a plurality of gain-shape decoding schemes on the received gain-shape coded LSF residual coefficients according to the received information on applied gain-shape coding scheme, in order to achieve LSF residual coefficients, where the plurality of gain-shape decoding schemes have mutually different trade-offs in one or more of gain resolution and shape resolution for one or more of the gain-shape coded LSF residual coefficients;

transforming (306) the LSF residual coefficients from a warped domain into an LSF original domain, and determining (308) LSF coefficients as the transformed LSF residual coefficients added with the received first compressed LSF coefficients.

To transform the coefficients from a warped domain into an LSF original domain signifies that the coefficients are warped back to the LSF residual domain in which they were before they were transformed into the warped domain at the encoder.

11. Method according to embodiment 10, wherein the received first compressed LSF coefficients are quantized LSF coefficients, the method further comprising de-quantizing (307) the quantized LSF coefficients using a first number of bits corresponding to the number of bits used for quantizing LSF coefficients at a quantizer of the encoder, and wherein the LSF coefficients are determined (308) as the transformed LSF residual coefficients added with the de-quantized LSF coefficients.

Method according to embodiment 11, further comprising receiving, over the communication channel from the encoder, the first number of bits used at a quantizer of the encoder.

The first number of bits may be predetermined between encoder and decoder. If not, information of the first number of bits is sent from the encoder to the decoder.

12. Method according to any of embodiments 10-12, wherein the plurality of gain-shape de-coding schemes comprises a PVQ regular de-coding scheme having a first approximately constant coefficient gain at 1.0 and a PVQ outlier de-coding scheme having a second coefficient gain that is selectable between a first and a second value.

13. Method according to any of embodiments 10-13, wherein the input LSF coefficients are DC component removed LSF coefficients.

According to another embodiment, a decoder is provided that is configured to perform any of the embodiments above performed by the decoder.

Abbreviations

LSF Line Spectral Frequencies
LSP Line Spectral Pairs
ISP Immitance Spectral Pairs
ISF Immitance Spectral Frequencies
VQ Vector Quantizer
MS-SVQ Multistage Split Vector Quantizer
PVQ Pyramid VQ
NPVQ Number of PVQ indices
MPVQ sign Modular PVQ enumeration scheme
MSE Mean Square Error
WMSE Weighed MSE
DCT Discrete Cosine Transform
RDCT Rotated (ACF based) DCT
LOG 2 Base 2 logarithm
SD Spectral Distortion
EVS Enhanced Voice Service
WB Wideband (typically an audio signal sampled at 16 kHz)
WMOPS Weighted Million Operations per Second
WC-WMOPS Worst Case WMOPS
AMR-WB Adaptive Multi-Rate Wide Band
DSP Digital Signal Processor
TCQ Trellis Coded Quantization
MUX MultipleXor (multiplexing unit)
DEMUX De-multipleXor (de-multiplexing unit)
ARE Arithmetic/Range Encoder
ARD Arithmetic/Range Decoder

The invention claimed is:

1. A method, performed by an encoder of a communication system, for handling input Line Spectral Frequency (LSF) coefficients, the method comprising the encoder:

determining LSF residual coefficients as first compressed LSF coefficients subtracted from the input LSF coefficients;

transforming the LSF residual coefficients into a warped domain;

applying one of a plurality of gain-shape coding schemes on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients; and transmitting, over a communication channel to a decoder, a representation of the first compressed LSF coefficients, the gain-shape coded LSF residual coefficients, and information on the applied gain-shape coding scheme.

2. The method of claim 1:

further comprising quantizing the input LSF coefficients using a first number of bits;

wherein the determining the LSF residual coefficients comprises subtracting the quantized LSF coefficients from the input LSF coefficients; and wherein the transmitted first compressed LSF coefficients are the quantized LSF coefficients.

3. The method of claim 1, wherein the applying the one of a plurality of gain-shape coding schemes on the transformed LSF residual coefficients comprises selectively applying the one of the plurality of gain-shape coding schemes.

4. The method of claim 3, wherein the selection in the selectively applying of the one of the plurality of gain-shape coding schemes is performed by a combination of a pyramid vector quantization (PVQ) shape projection and a shape fine search to reach a first PVQ pyramid code point over available dimensions on a per LSF residual coefficient basis.

5. The method of claim 3, wherein the selection in the selectively applying of the one of the plurality of gain-shape coding schemes is performed by a combination of a pyramid vector quantization (PVQ) shape projection and a shape fine search to reach a first PVQ pyramid codepoint over available dimensions followed by another shape fine search to reach a second PVQ pyramid code point within a restricted set of dimensions.

6. The method of claim 1, wherein the plurality of gain-shape coding schemes comprises a pyramid vector quantization (PVQ) regular coding scheme having a first approximately constant coefficient gain at 1.0, and a PVQ outlier coding scheme having a second coefficient gain that is selectable between a first and a second value.

7. The method of claim 1, wherein the plurality of gain-shape coding schemes use mutually different bit resolutions for different subsets of LSF residual coefficients.

8. The method of claim 1, wherein the input LSF coefficients are mean removed LSF coefficients.

9. The method of claim 1, further comprising transforming the first compressed LSF coefficients into a warped domain.

10. A method, performed by a decoder, of a communication system for handling Line Spectral Frequency (LSF) coefficients, the method comprising the decoder:

receiving, over a communication channel and from an encoder, a representation of first compressed LSF coefficients, gain-shape coded LSF residual coefficients, and information on an applied gain-shape coding scheme, applied by the encoder;

applying one of a plurality of gain-shape decoding schemes on the received gain-shape coded LSF residual coefficients according to the received information on applied gain-shape coding scheme, in order to achieve LSF residual coefficients, where the plurality of gain-shape decoding schemes have mutually different trade-offs in one or more of gain resolution and shape resolution for one or more of the gain-shape coded LSF residual coefficients;

transforming the LSF residual coefficients from a warped domain into an LSF original domain, and determining LSF coefficients as the transformed LSF residual coefficients added with the received first compressed LSF coefficients.

11. The method of claim 10:

wherein the received first compressed LSF coefficients are quantized LSF coefficients;

further comprising de-quantizing the quantized LSF coefficients using a first number of bits corresponding to the number of bits used for quantizing LSF coefficients at a quantizer of the encoder; and wherein the LSF coefficients are determined as the transformed LSF residual coefficients added with the de-quantized LSF coefficients.

12. The method of claim 10, further comprising receiving, over the communication channel and from the encoder, the first number of bits used at a quantizer of the encoder.

13. The method of claim 10, wherein the plurality of gain-shape de-coding schemes comprises a pyramid vector quantization (PVQ) regular de-coding scheme having a first approximately constant coefficient gain at 1.0, and a PVQ outlier de-coding scheme having a second coefficient gain that is selectable between a first and a second value.

14. The method of claim 10, wherein the input LSF coefficients are mean removed LSF coefficients.

15. An apparatus for handling input Line Spectral Frequency (LSF) coefficients, the apparatus comprising:

processing circuitry;

memory containing instructions executable by the processing circuitry whereby the apparatus is operative to:

determine LSF residual coefficients as first compressed LSF coefficients subtracted from the input LSF coefficients;

transform the LSF residual coefficients into a warped domain;

apply one of a plurality of gain-shape coding schemes on the transformed LSF residual coefficients in order to achieve gain-shape coded LSF residual coefficients, where the plurality of gain-shape coding schemes have mutually different trade-offs in one or more of gain resolution and shape resolution for one or more of the transformed LSF residual coefficients; and transmit, over a communication channel and to a decoder, the first compressed LSF coefficients, the gain-shape coded LSF residual coefficients, and information on the applied gain-shape coding scheme.

16. The apparatus of claim 15:

wherein the instructions are such that the apparatus is operative to:

quantize the input LSF coefficients using a first number of bits; and determine LSF residual coefficients by subtracting the quantized LSF coefficients from the input LSF coefficients;

wherein the transmitted first compressed LSF coefficients are the quantized LSF coefficients.

17. The apparatus of claim 15, wherein the instructions are such that the apparatus is operative to selectively apply one of the plurality of gain-shape coding schemes on the transformed LSF residual coefficients.

18. The apparatus of claim 15, wherein the instructions are such that the apparatus is operative to remove a mean from the input LSF coefficients.

19. The apparatus of claim 15, wherein the instructions are such that the apparatus is operative to transform the first compressed LSF coefficients into a warped domain.

20. An apparatus for handling input Line Spectral Frequency (LSF) coefficients, the apparatus comprising:

processing circuitry;

memory containing instructions executable by the processing circuitry whereby the apparatus is operative to:

receive, over a communication channel and from an encoder, a representation of first compressed LSF coefficients, gain-shape coded LSF residual coefficients, and information on an applied gain-shape coding scheme, applied by the encoder;

apply one of a plurality of gain-shape decoding schemes on the received gain-shape coded LSF residual coefficients according to the received information on applied gain-shape coding scheme, in order to achieve LSF residual coefficients, where the plurality of gain-shape decoding schemes have mutually different trade-offs in one or more of gain resolution and shape resolution for one or more of the gain-shape coded LSF residual coefficients;

transform the LSF residual coefficients from a warped domain into an LSF original domain; and determine LSF coefficients as the transformed LSF residual coefficients added with the received first compressed LSF coefficients.

* * * * *